US008534249B2

(12) United States Patent
Sullivan et al.

(10) Patent No.: US 8,534,249 B2
(45) Date of Patent: Sep. 17, 2013

(54) ROCKER ARM ASSEMBLY WITH AN ANTI-INVERSION FEATURE

(75) Inventors: Mark Sullivan, Rochester Hills, MI (US); Jesse Myers, Waterford, MI (US); Richard Baker, Sterling Heights, MI (US); William Carter, Cheraw, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 9 days.

(21) Appl. No.: 13/230,520

(22) Filed: Sep. 12, 2011

(65) Prior Publication Data

US 2012/0060781 A1 Mar. 15, 2012

Related U.S. Application Data

(60) Provisional application No. 61/382,076, filed on Sep. 13, 2010.

(51) Int. Cl.
*F01L 1/183* (2006.01)
*F01L 1/185* (2006.01)

(52) U.S. Cl.
USPC ..... 123/90.42; 123/90.39

(58) Field of Classification Search
USPC ..... 123/90.39, 90.41, 90.42, 90.47, 90.16; 74/559; 470/3, 41
See application file for complete search history.

(56) References Cited

U.S. PATENT DOCUMENTS

| | | | | |
|---|---|---|---|---|
| 2,265,905 | A * | 12/1941 | Hesse et al. | 411/249 |
| 3,198,183 | A * | 8/1965 | Ball | 123/90.42 |
| 4,393,820 | A * | 7/1983 | Maki et al. | 123/90.41 |
| 5,437,209 | A * | 8/1995 | Santoro | 74/559 |
| 6,694,936 | B2 * | 2/2004 | Stallmann | 123/90.41 |
| 7,318,399 | B2 * | 1/2008 | Methley | 123/90.16 |
| 2008/0098971 | A1 | 5/2008 | Baker | |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

The rocker arm assembly has an anti-inversion part that prevents a support pin from inverting, ensuring proper orientation of the support pin, on which a rocker arm is rotatably mounted, is maintained. The anti-inversion part can be a washer, a plate, a plug, or a sleeve. The washer, which has a flat face and a curved face, is intended for use with a cylindrical support pin which matches the curved face of the washer. The plate can include various combinations of tabs, flanges, and/or protrusions that extend in different directions. The plug can resemble any desirable shape, and is removed prior to final assembly. The sleeve can be hollow and is removable.

17 Claims, 37 Drawing Sheets

ROCKER ARM ASSEMBLY WITH AN ANTI-INVERSION FEATURE

FIELD OF THE INVENTION

This invention relates to rocker arm assemblies for a valve train of an internal combustion engine and, more particularly, to an anti-inversion feature used in a rocker arm assembly to ensure proper orientation of a support pin, on which the rocker arm is rotatably mounted, is maintained.

BACKGROUND OF THE INVENTION

Pedestal mounted rocker arm assemblies have a rocker arm rotatably mounted on a support pin which in turn is fixed to a cylinder head through a pedestal. The support pin is also known as a trunnion. Conventionally, the support pin rests on the pedestal, also known as a support block, which positions the overall rocker arm assembly away from the cylinder head. One end of the rocker arm is in contact with the push rod while the other end of the rocker arm is in contact with a valve shaft.

Roller bodies, also referred to as radial bearings, are conventionally used between the support pin and the rocker arm to facilitate rotational movement of the rocker arm on the support pin and to handle radial loads.

Moreover, an inner sleeve and an outer sleeve can be used. When incorporated into the rocker arm assembly, the inner sleeve and the outer sleeve are positioned between a through-hole in the rocker arm and the support pin is affixed within the inner sleeve. Furthermore, the rocker arm assembly can include rolling elements that are positioned between the inner sleeve and outer sleeve to accommodate radial loads.

Rocker arm assemblies can also be subject to axial forces or thrust forces. These axial forces occur when certain parts are out of alignment, for example, when the rocker arm pallet and the socket, the lower end of the push rod and the socket, or the valve shaft and the rocker arm pallet are out of alignment. Such rocker arm assemblies are often referred to as "offset rocker arm assemblies."

To ensure the support pin, which typically has a flat upper surface and a concave lower surface that contacts the pedestal, does not become inverted prior to final installation a captured fastener is typically affixed in a centrally located bore in the support pin. Essentially, a captured fastener is a washer that has a circular flange extending from one side of the washer with threading on the inside of the flange. A bolt is also typically inserted in the captured fastener and bore prior to final assembly.

Rocker arm assemblies utilizing a captured fastener are known, see, for example, U.S. Pat. No. 6,694,936 and U.S. patent application No. 2008/0098971. Such rocker arms employ a captured fastener and a fastening bolt to ensure the support pin does not become inverted prior to final installation of the rocker arm to the engine. The use of the captured fastener and fastening bolt adds to the cost and packaging envelope of the rocker arm assembly. Also, in certain instances, captured fasteners cannot be used.

Additionally, see, for example, U.S. Pat. No. 5,437,209, which discloses a rocker arm assembly. The support pin of the rocker arm assembly has a D-shaped feature at each end to prevent the support pin from inverting. The support pin engages in a D-shaped hole stamped into the outer bearing cup, coupled with an inner bearing sleeve that has a specified range of diametric clearances to the support pin journal, preventing the support pin from inverting. The geometry required to achieve the D-shaped features on the support pin and associated components is complex, which adds to the overall cost and time required to manufacture the rocker arm components that incorporate the D-shaped feature.

SUMMARY OF THE INVENTION

The present invention is directed to an anti-inversion feature that is incorporated into a rocker arm assembly. The anti-inversion feature prevents the support pin from inverting prior to final assembly of the rocker arm in an internal combustion engine. Thus, incorporating the anti-inversion feature into the rocker arm assembly will ensure the support pin remains in an upright position and will not become inverted between initial assembly and final installation in an internal combustion engine.

Specifically, the anti-inversion feature can be a washer, a plate, a plug, or a sleeve. The washer, which is intended for use with a cylindrical support pin, has a predominately flat face on one side and a curved face on the other. The curved face of the washer is intended to rest on a mating curved surface of the support pin. The plate, which has a flange that extends into the bore of the support pin, can include various combinations of a tab(s) and/or a protrusion(s) that extend in an upward direction, contacting the walls of a central opening in the rocker arm and/or downward direction, contacting the support pin. The plug, which can resemble any desirable shape, must be removed prior to final assembly and the sleeve, which is tubular, can be hollow and can either be removed or remain fixed in the bore of the support pin.

Broadly, the present invention can be defined as a rocker arm assembly for use in an internal combustion engine that comprises a rocker arm which has a transverse through-hole, a support pin which has a body with a centrally located bore and which is positioned in the through-hole and about which the rocker arm rocks, a bearing which is positioned at each end of the support pin in the through-hole between the support pin and the rocker arm, and an anti-inversion part which is affixed in the bore of the support pin.

The rocker arm can further comprise an outer sleeve that abuts an inner circumferential wall of the through-hole and an outer bearing wall that extends radially inward and covers the through-hole. Also, the rocker arm can further comprise an inner sleeve that abuts an outer circumferential wall of the support pin and an inner bearing wall that extends radially inward and covers an axial end wall of the support pin. The outer bearing wall can abut the inner bearing wall and can accommodate axial loads. Additionally, rolling elements can be positioned between and in contact with the inner sleeve and outer sleeve to accommodate radial loads.

The body of the support pin can have a flat upper surface and a curved lower surface. Alternatively, the body of the support pin can be entirely cylindrical with a central section and two ends. The central section can have a smooth, cylindrical surface and the ends, which are located on each side of the central section, can be stepped and narrower in diameter than the central section.

In one aspect of the invention, anti-inversion part can be a washer with a centrally located hole that has a first surface and a second surface. The first surface can be predominately flat and the second surface can have a predominately curved contour. The first surface further can have beveled faces at an edge of the washer and at the hole, and the second surface can have beveled faces along the curved contour. The second surface of the washer can engage a curved surface on a top portion of the support pin. Also, a fastening bolt can be secured in the bore of the support pin with the washer providing spacing between the bolt and the support pin. When a bolt is secured in the bore, the first surface of the washer is in contact with a head of the bolt and the second surface of the washer is in contact with the body of the support pin.

Further, the rocker arm can have a central opening, which is defined by a first wall, a second wall, a third wall, and a fourth wall. The first wall and the third wall face each other and the second wall and the fourth face each other and are transverse to the first wall and the third wall.

In accordance with another aspect of the invention, the anti-inversion feature can be a plate with a beveled hole connected to a hollow extension that engages in the bore of the supporting pin. The plate can be rectangular and, upon movement of the rocker arm, the plate is contactable with any of the walls of the rocker arm.

Alternatively, the plate can be predominately circular and have a tab which extends in a transverse direction. The tab can be at least one protrusion which extends in a generally upward direction. The protrusion can extend from an axial extending end of the tab and has a finger extending in a generally horizontal direction that contacts anywhere on the rocker arm, such as at an oil rail on a top area of the rocker arm.

In a further aspect of the invention, the plate can have a first generally extending vertical flange and a second generally extending vertical flange in opposite transverse directions. The first vertical flange and the second vertical flange can be contactable with the first wall or the third wall of the central opening of the rocker arm. The plate further can have tabs which are bendable downwardly, engaging the support pin to prevent the plate from rotating during tightening of a fastening bolt. The tabs can be on opposite sides of the plate, next to the first vertical flange and the second vertical flange, and diagonally opposite each other.

In yet another aspect of the invention, the anti-inversion feature can be a removable plug. The plug can have an upper portion, a central portion, and a lower portion. The upper portion and the lower portion can each be any shape. For example, the upper portion and the lower portion can be X-shaped or can be shaped in the form of a plus sign. The central portion can also be any shape, such as a circular disk, located between the upper portion and the lower portion. The lower portion is press fit in the bore of the support pin, the central portion rests on the support pin to keep the plug located vertically on the support pin, and the upper portion extends vertically from the central portion and is contactable upon movement of the rocker arm with walls in a central opening of the rocker arm, preventing inversion of the support pin.

In yet a further aspect of the invention, the anti-inversion feature can be a sleeve, which can be hollow. The sleeve can extend through the bore of the support pin and rocker arm, and is contactable upon movement of the rocker arm with bottom walls of the rocker arm, preventing inversion of the support pin. The sleeve can be removable if desired. Also, a bolt can be inserted in the sleeve during assembly of the rocker arm.

BRIEF DESCRIPTION OF THE DRAWINGS

The present invention will be further understood and appreciated by reading the following description in conjunction with the accompanying drawings, in which.

DETAILED DESCRIPTION OF THE DRAWINGS

Figure 1:
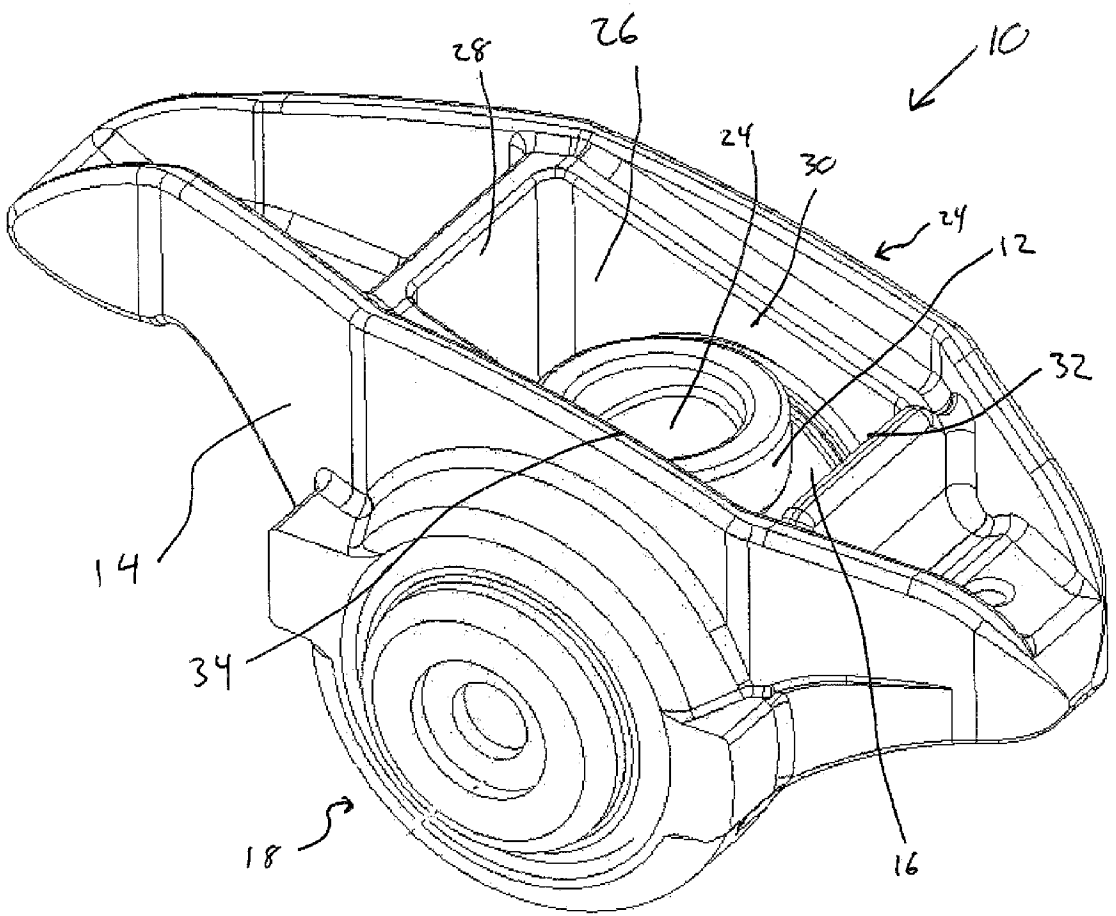
FIG. 1 is a perspective view of the rocker arm assembly with an anti-inversion washer installed in the rocker arm assembly.

FIG. 1 illustrates a rocker arm assembly 10 which accommodates an anti-inversion part 12. The rocker arm assembly 10 has a rocker arm 14 which rotates about a support pin 16. The support pin 16 passes through a transverse through-hole 18 in the side walls 20, 22 of the rocker arm 14. The support pin 16 has a bore 24, on which the anti-inversion washer 12 is positioned, centrally located in the body of support pin 16. The bore 24 is positioned in a central opening 26 of rocker arm 14. The central opening 26 has a first wall 28, a second wall 30, a third wall 32, and a fourth wall 34. The first wall 28 and the third wall 32 face each other and the second wall 30 and the fourth wall 34, which are transverse to the first wall 28 and the third wail 32, face each other.

The rocker arm assembly 10 is a straight line rocker arm. However, it should be understood that the anti-inversion parts 12, 70, 82, 102, 118, 126 of the present invention can also be used in offset rocker arm assemblies where the push rod, the ball socket and the rocker arm pallet (all not shown) do not lie on the same longitudinal plane. Such a rocker arm assembly is often chosen to accommodate large exhaust and intake port geometries which are needed to meet engine power requirements while meeting packaging constraints.

Figure 2:
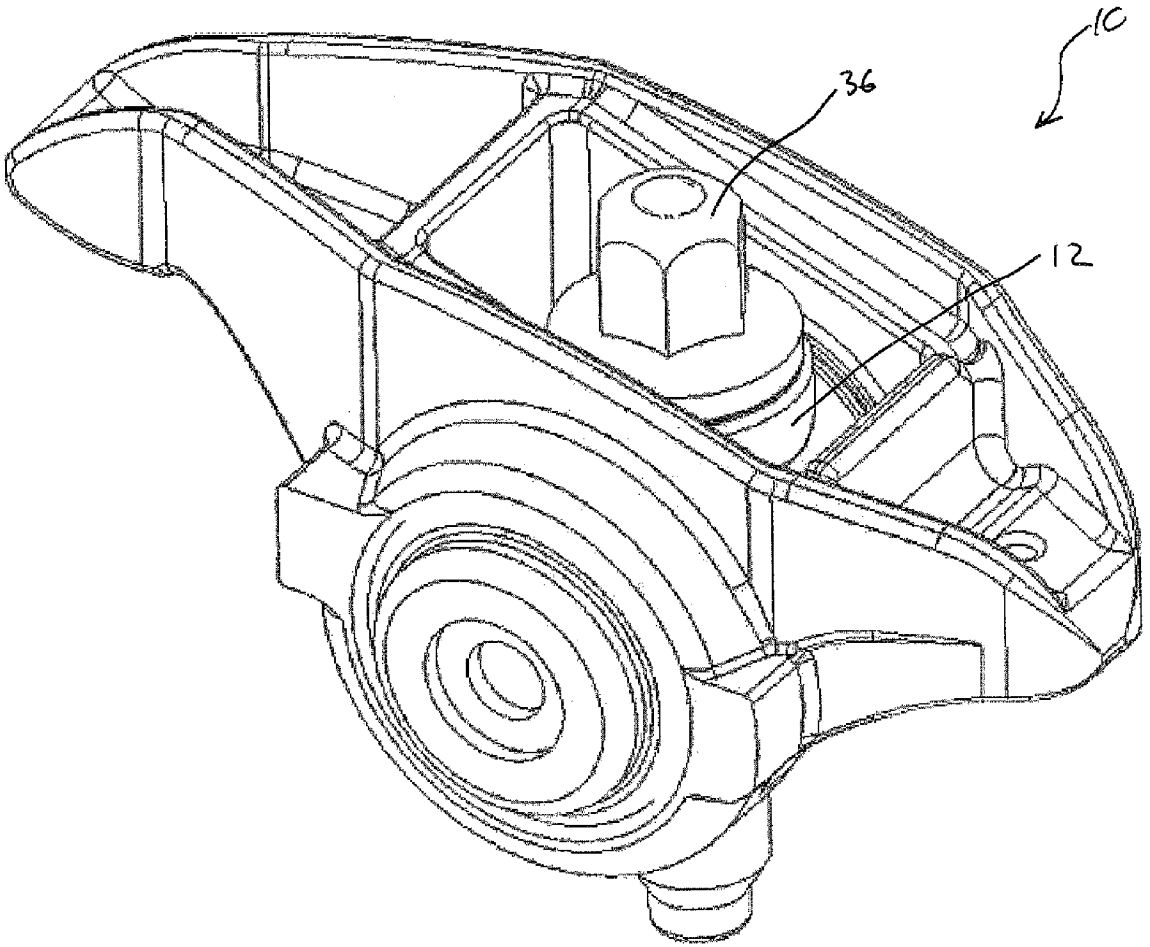
FIG. 2 is a perspective view of the rocker arm assembly with the washer and fastening bolt installed.

FIG. 2 illustrates the rocker arm assembly 10 with the washer 12 and a fastening bolt 36 installed.

Figure 3:
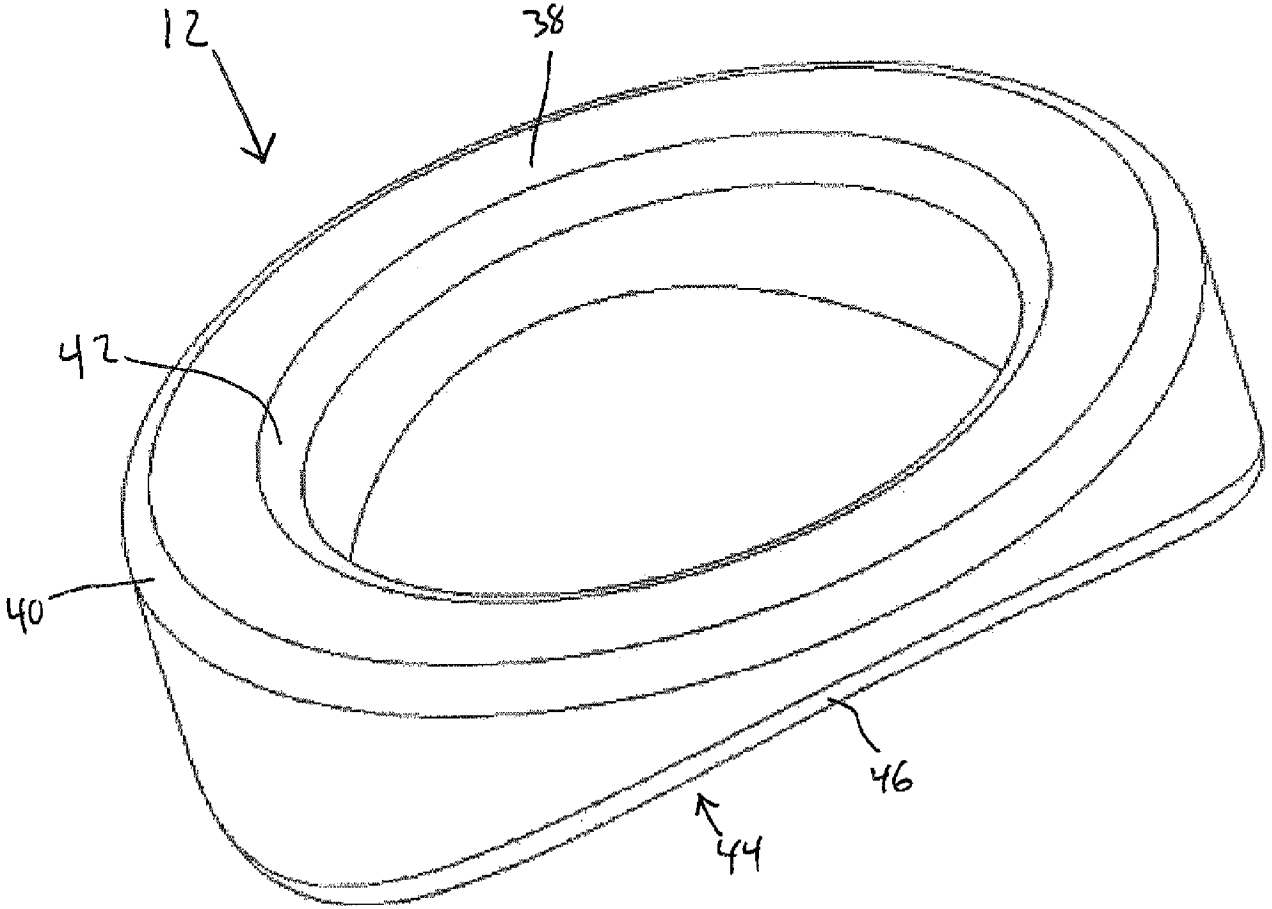
FIG. 3 is a perspective view of the washer.

FIG. 3 illustrates the washer 12. The washer 12, as shown, has a flat top 38 with beveled edges 40, 42 and a curved bottom 44 that also has beveled edges 46.

Figure 4:
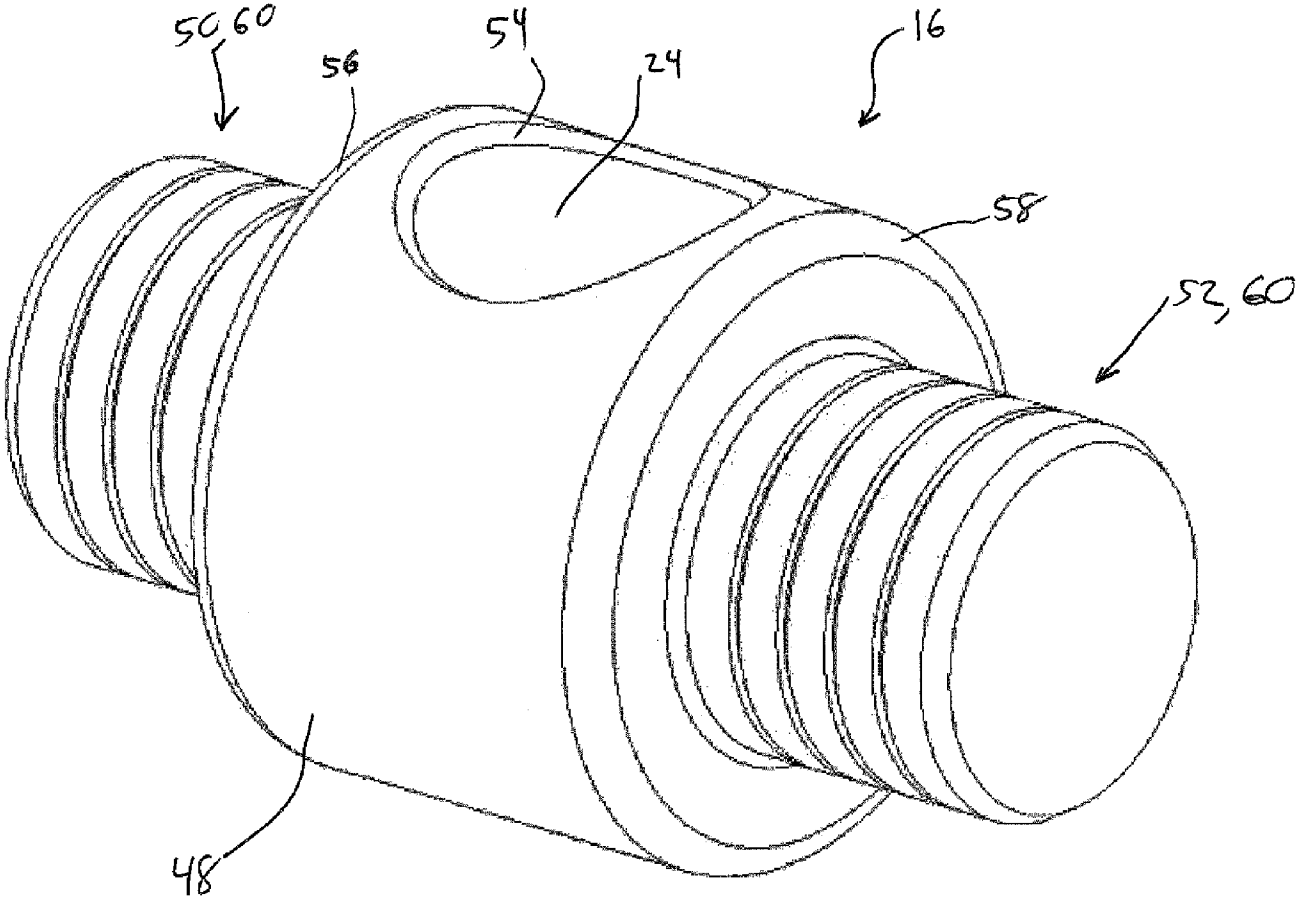
FIG. 4 is a perspective view of a cylindrical support pin.

FIG. 4 illustrates the support pin 16 that is intended for use with the washer 12. The support pin 16 has a central section 48 and two ends 50, 52. The central section 48, in which the bore 24 is located, has a predominately smooth, cylindrical surface and bevel surface 54 surrounding the bore 24 and beveled surfaces 56, 58 at the sides of the central section 48 where the ends 50, 52 and the central section 48 meet. The ends 50, 52, which are located on each side of the central section 48, are stepped 60 and narrower in diameter than the central section 48.

Figure 5:
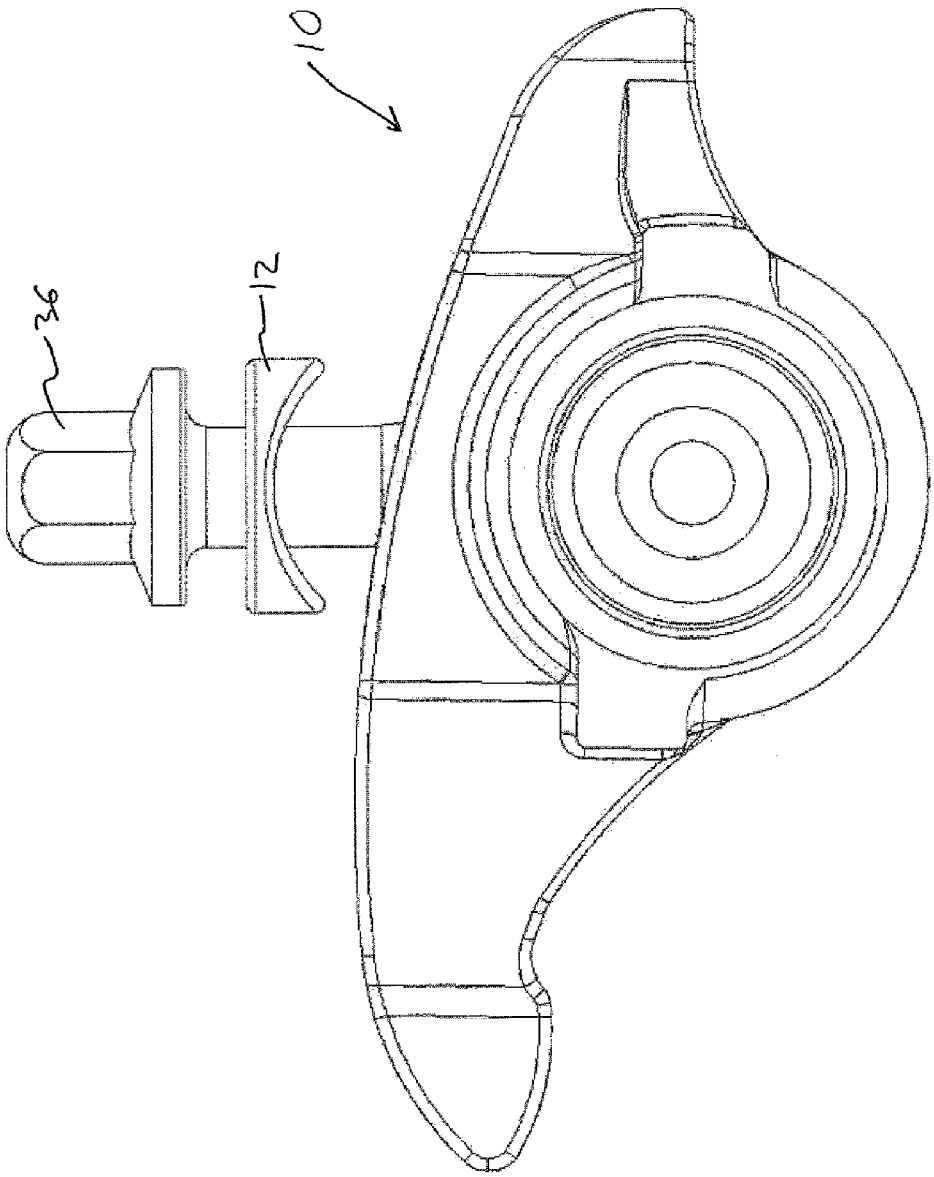
FIG. 5 is a side view illustrating the washer and the fastening bolt being installed in the rocker arm assembly.

FIG. 5 illustrates the rocker arm assembly 10 with the washer 12 and the fastening bolt 36, prior to final installation, being installed in the rocker arm assembly 10.

Figure 6:
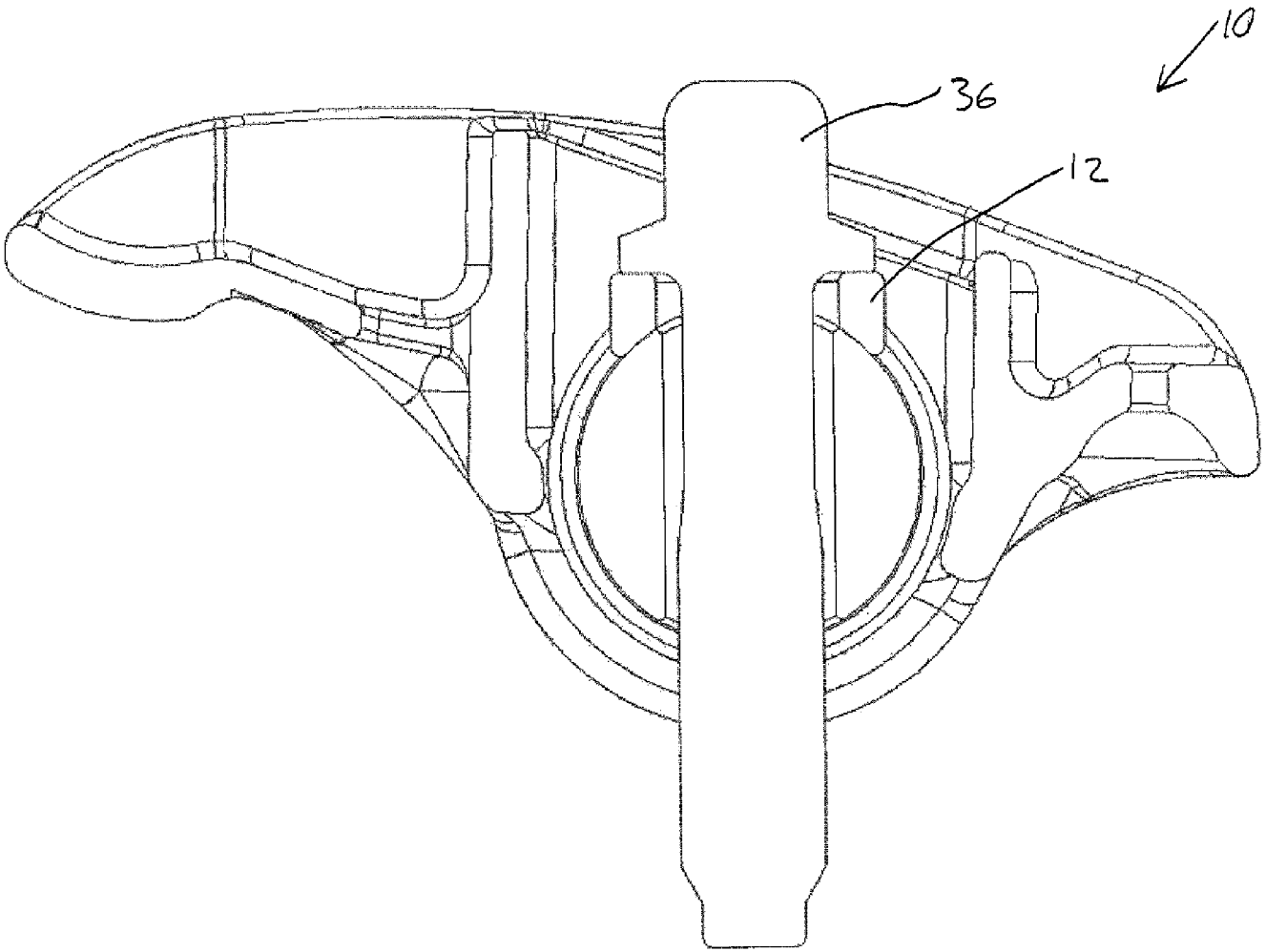
FIG. 6 is a side cross-sectional view illustrating the washer and the fastening bolt installed in the rocker arm assembly.

FIG. 6 illustrates a side cross-sectional view of the rocker arm assembly 10 with the washer 12 and the fastening bolt 36 installed. As illustrated, the washer 12 rests predominately on the cylindrical support pin 16.

Figure 7:
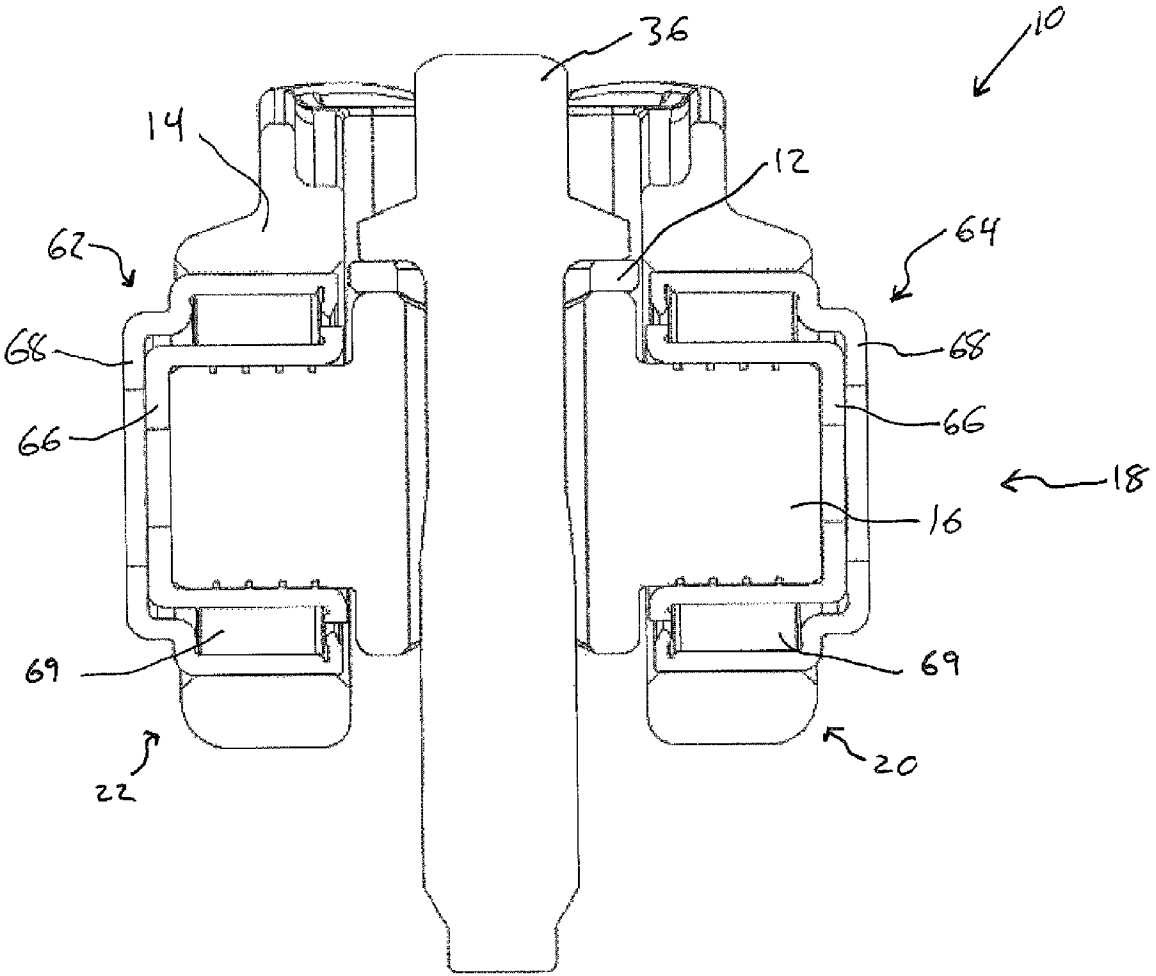
FIG. 7 is a transverse cross-sectional view of the rocker arm assembly with the washer and the fastening bolt in an installed state.

As shown in FIG. 7, the through-hole 18 passes through the rocker aim side walls 20, 22. The support pin 16 is positioned in the through-hole 18 and allows the rocker arm 14 to rotate. A bearing 62, 64 is positioned at each axial end of the support pin 16. Each bearing 62, 64, as shown, optionally has an inner sleeve 66, an outer sleeve 68, and rolling elements 69 positioned between the inner sleeve 66 and the outer sleeve 68. The rolling elements 69 are illustrated as generally cylindrical, however, needle rollers or spherical rollers can be employed. This arrangement handles radial forces in the rocker arm assembly.

Figure 8:
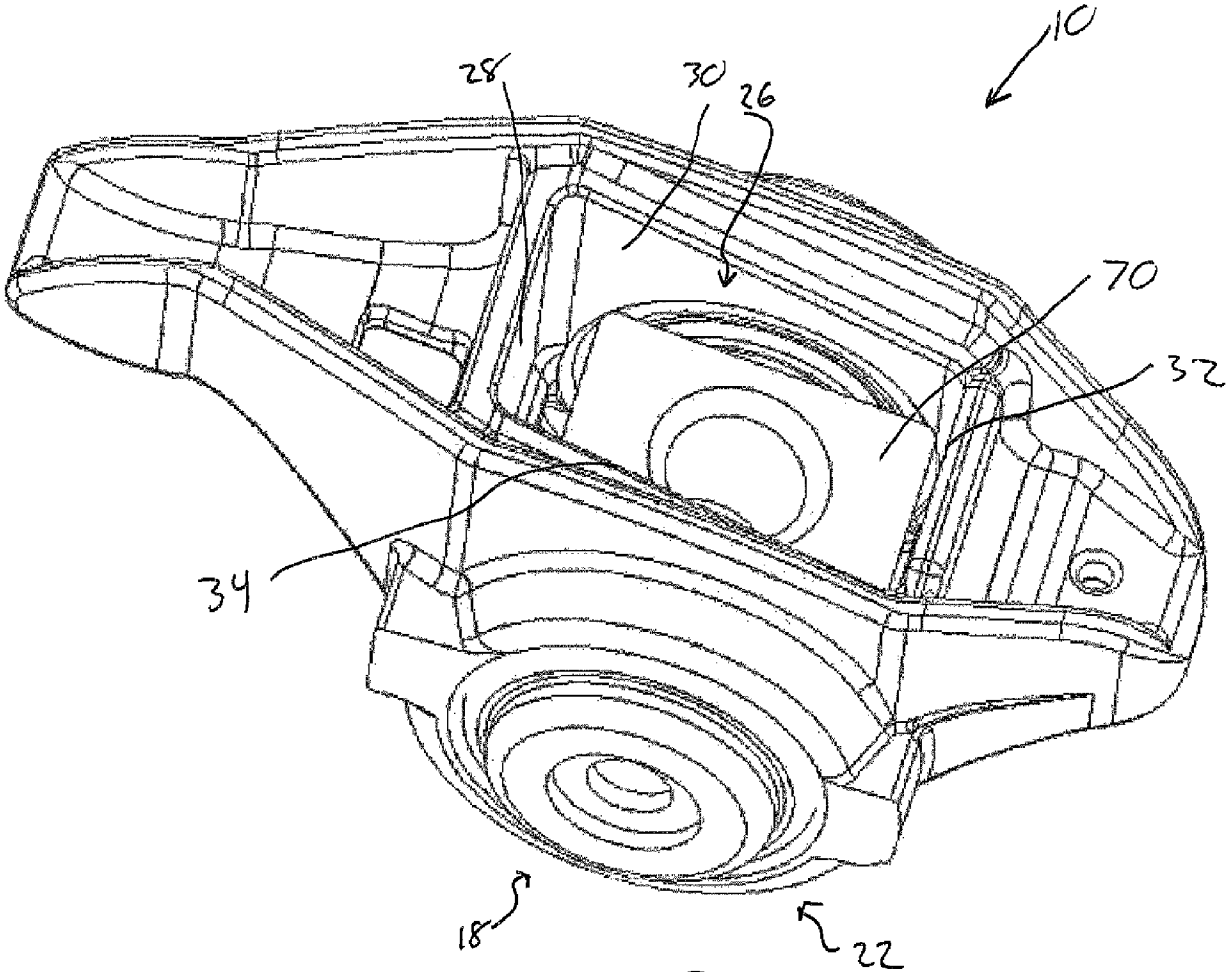
FIG. 8 is a perspective view of the rocker arm assembly with one embodiment of an anti-inversion plate installed in the rocker arm assembly.

FIG. 8 illustrates a perspective view of one embodiment of another anti-inversion part, a plate 70, installed in the rocker arm assembly 10. The plate 70 is installed in a bore 72 of a support pin 74 and prevents the support pin 74 from inverting by contacting either the first wall 28 or the third wall 32 of the central opening 26.

Figure 9:
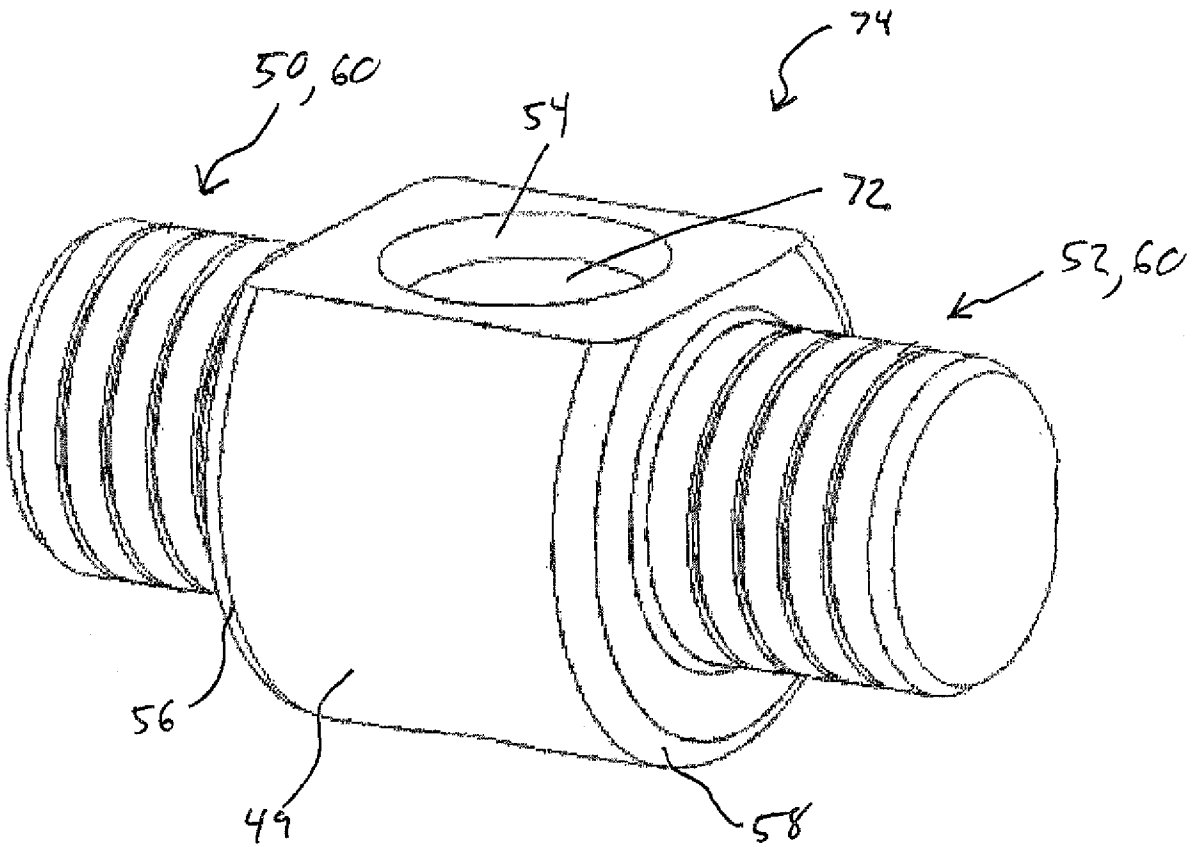
FIG. 9 is a perspective view of a cylindrical support pin.

FIG. 9 illustrates the support pin 74. The support pin 74 has a central section 49 and two ends 50, 52. The central section 49, in which the bore 72 is located, has a predominately flat upper surface and a curved lower surface with a bevel surface 54 surrounding the bore 72 and beveled surfaces 56, 58 at the sides of the central section 49 where the ends and the central section 49 meet. The ends 50, 52, which are located on each side of the central section 49, are stepped 60 and narrower in diameter than the central section 49.

Figure 10:
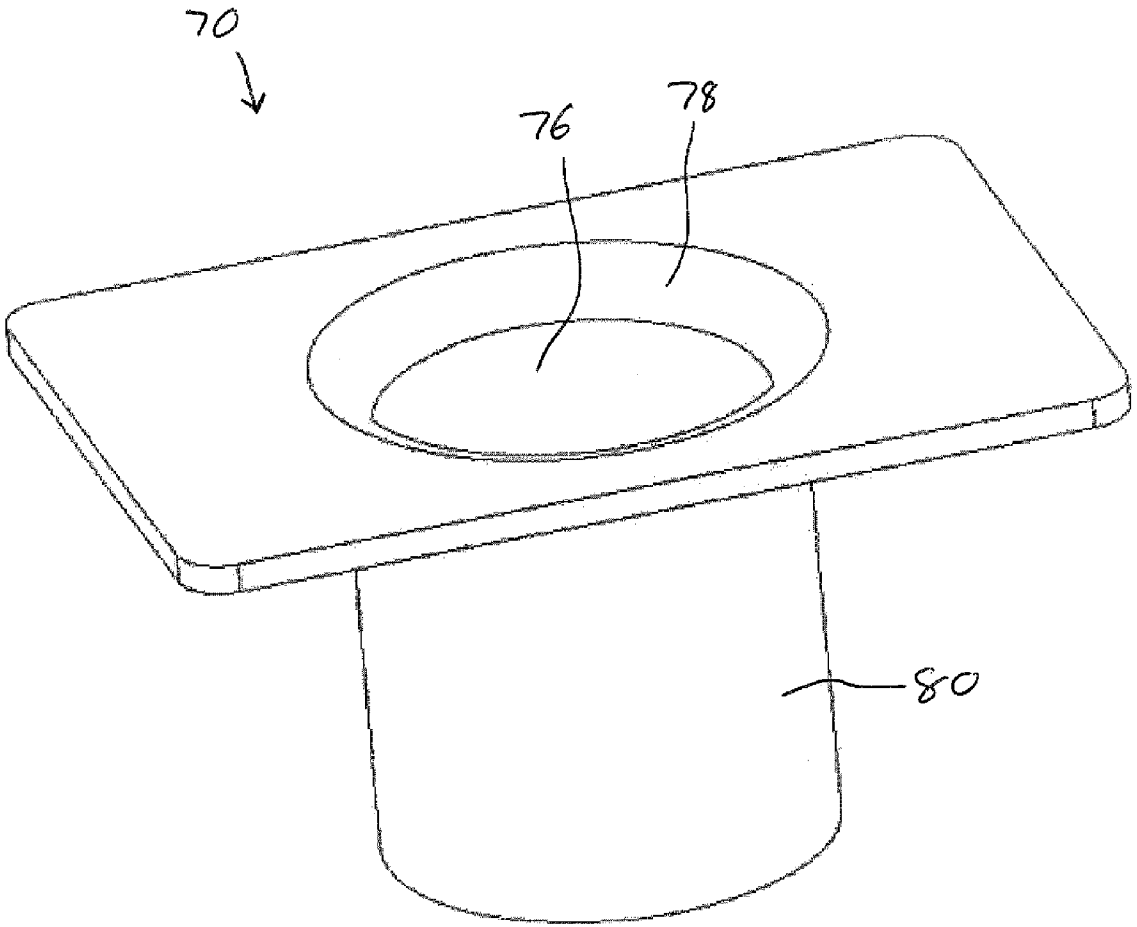
FIG. 10 is a perspective view of the plate.

FIG. 10 illustrates a perspective view of the plate 70 which, as shown, is rectangular. The plate 70 has a central hole 76 that is beveled 78 connected to a hollow extension 80. The hollow extension 80 is fixed in the bore 72 of the support pin 74.

Figure 11:
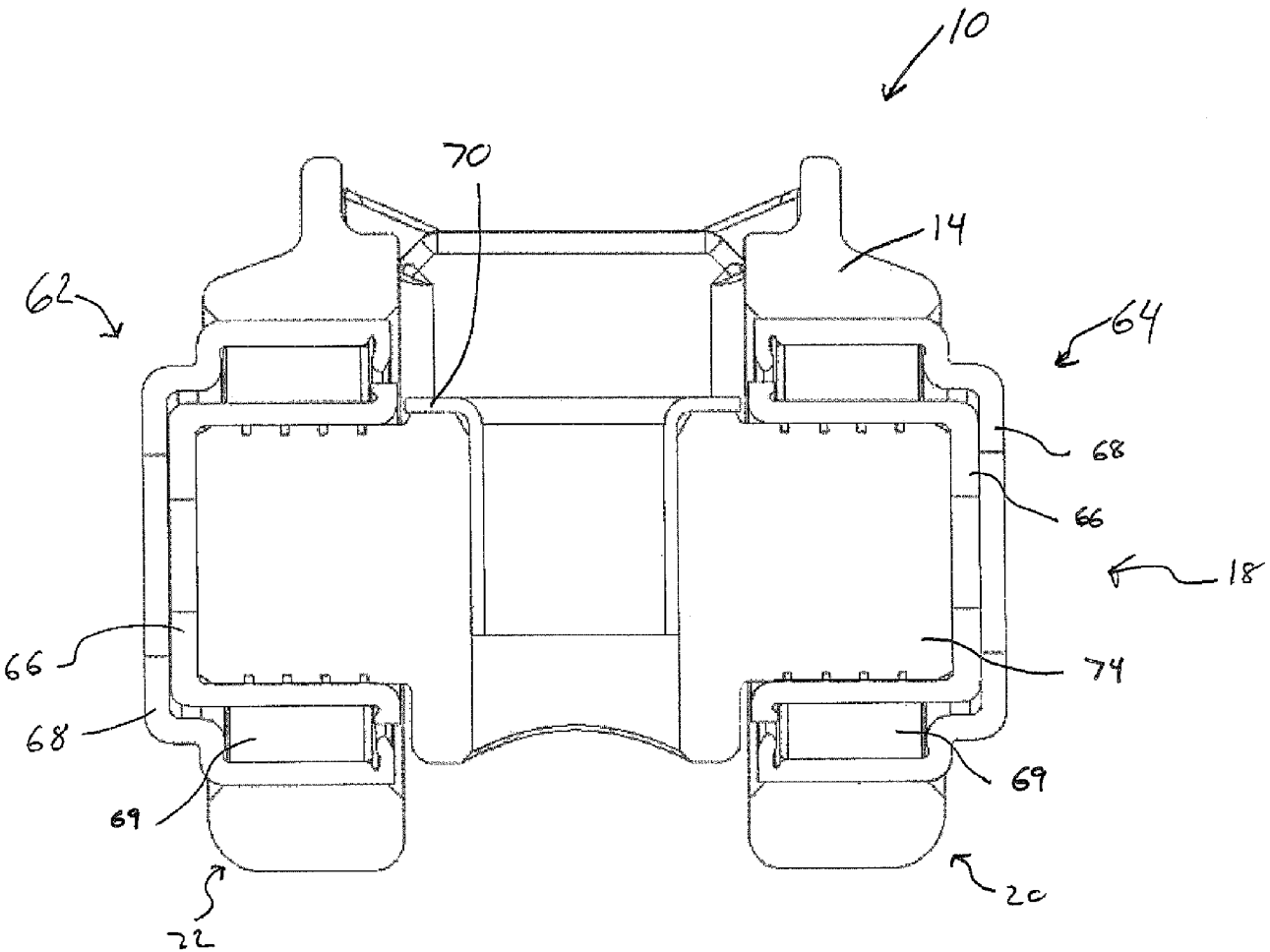
FIG. 11 is a transverse cross-sectional view of the rocker arm assembly with the rectangular plate in an installed state.

FIG. 11 illustrates a cross-sectional view of the rocker arm assembly 10 with the rectangular plate 70 installed. As shown, bearings 62, 64 are positioned at each axial end of the support pin 74 with an inner sleeve 66, an outer sleeve 68 and rolling elements 69 positioned between the inner sleeve 66 and the outer sleeve 68.

Figure 12:
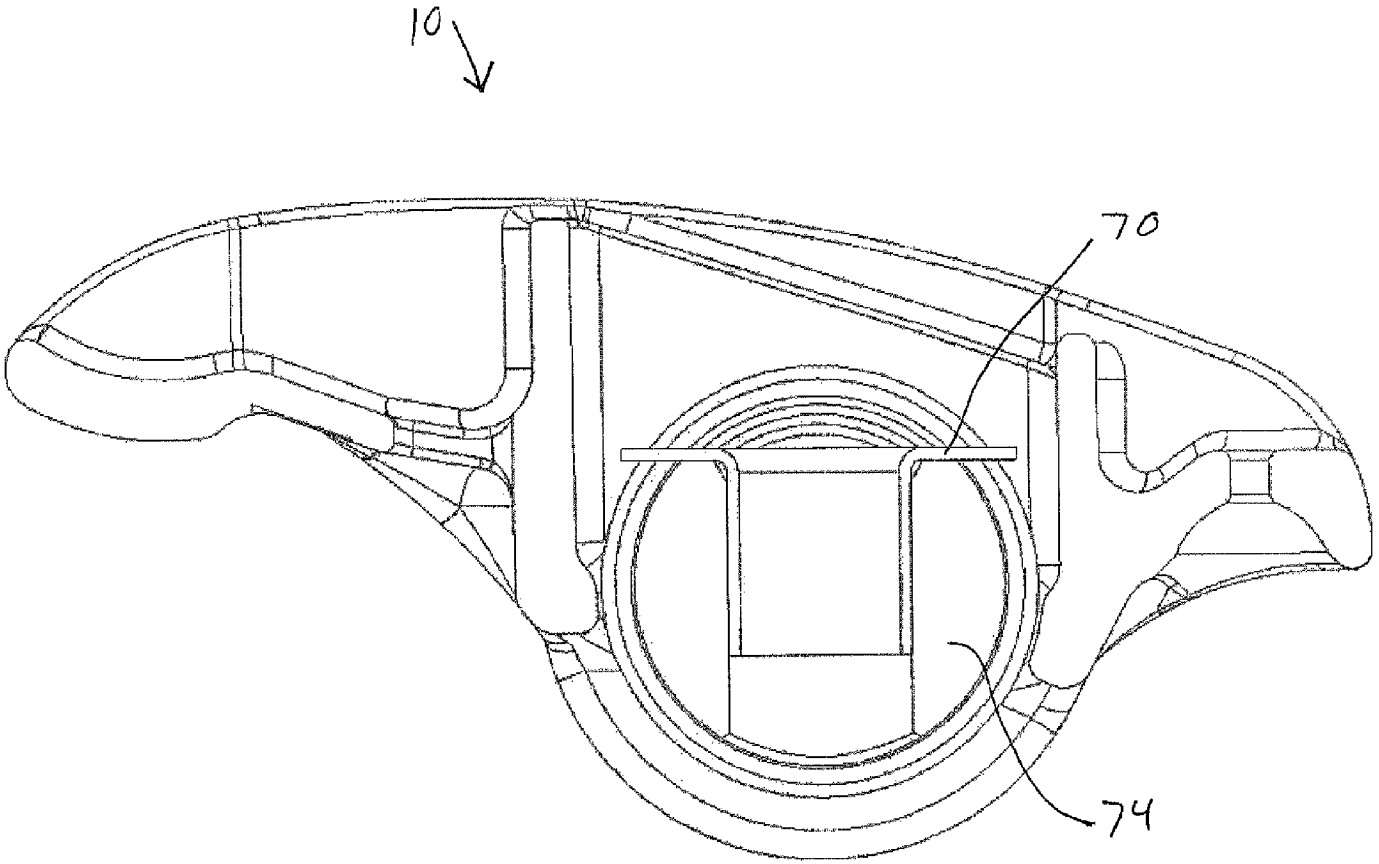
FIG. 12 is a side cross-sectional view illustrating the plate installed in the rocker arm assembly.

Similarly, FIG. 12 illustrates a side cross-sectional view of the plate 70 installed in the rocker arm assembly 10.

Figure 13:
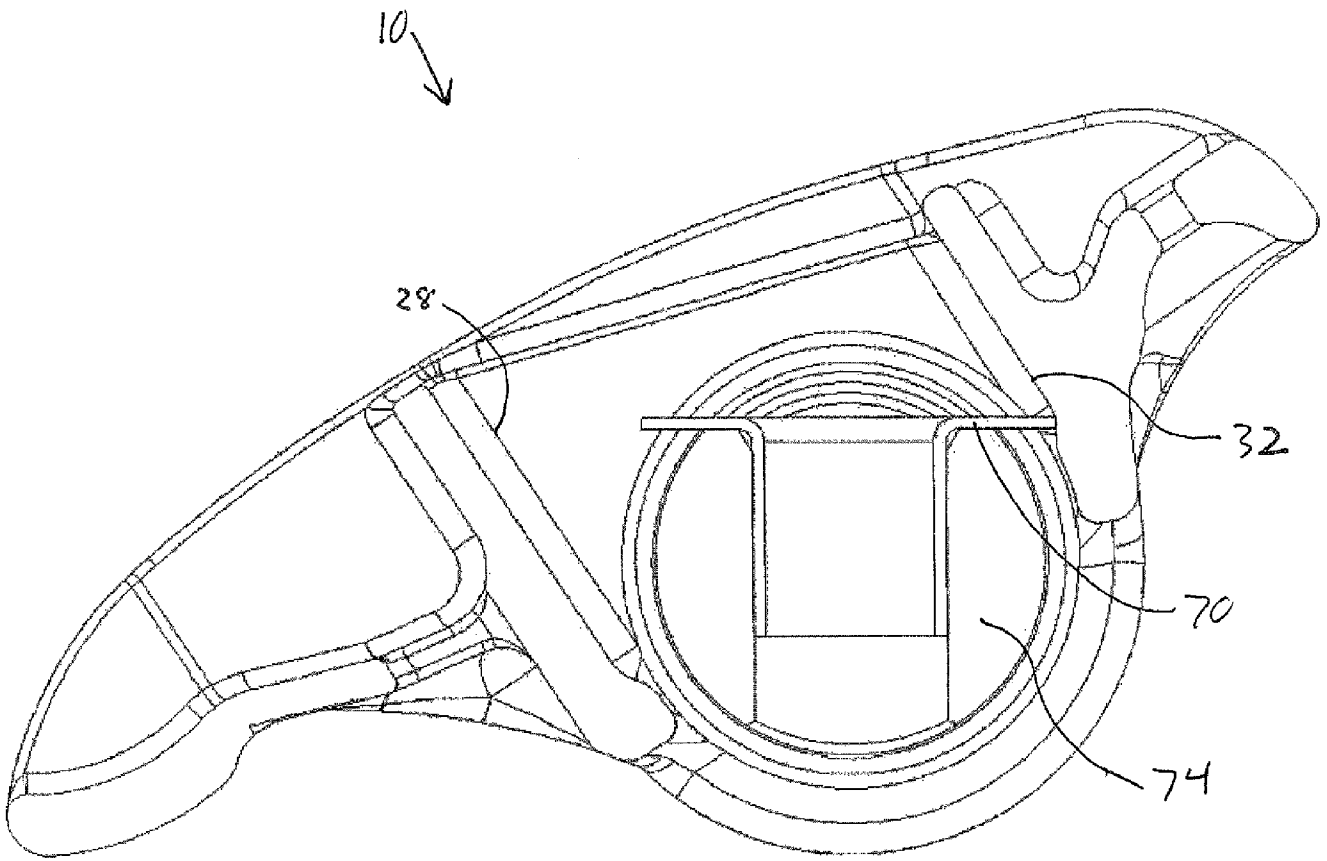
FIG. 13 is a side cross-sectional view illustrating the plate installed in the rocker arm assembly with the plate contacting one of the walls of the rocker arm.
Figure 14:
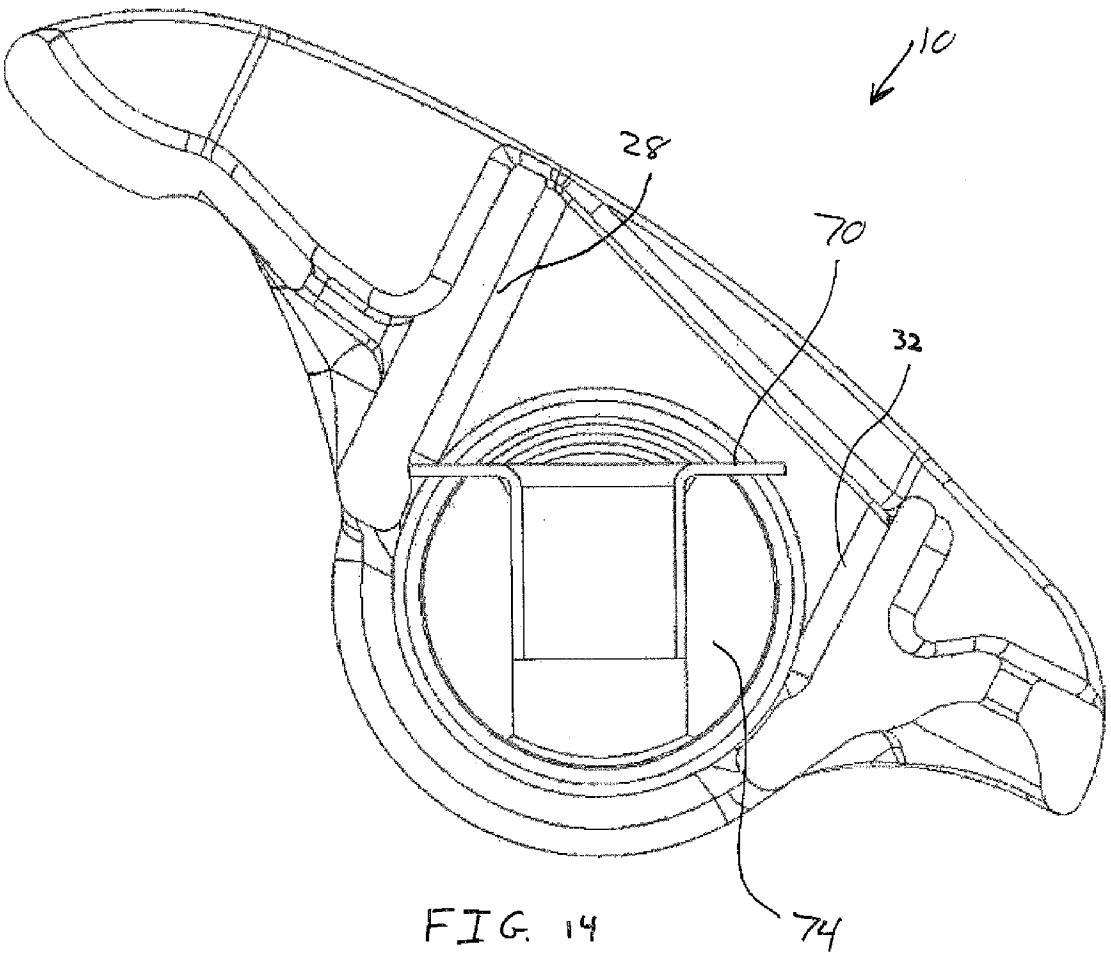
FIG. 14 is a side cross-sectional view illustrating the plate installed in the rocker arm assembly with the plate contacting a wall of the rocker arm opposite the wall that the plate contacted in FIG. 13.

FIGS. 13-14 illustrate the plate 70 contacting one of the walls 28, 32 of the rocker arm 14 when the rocker arm 14 is in motion, which prevents the support pin 74 from inverting.

Figure 15:
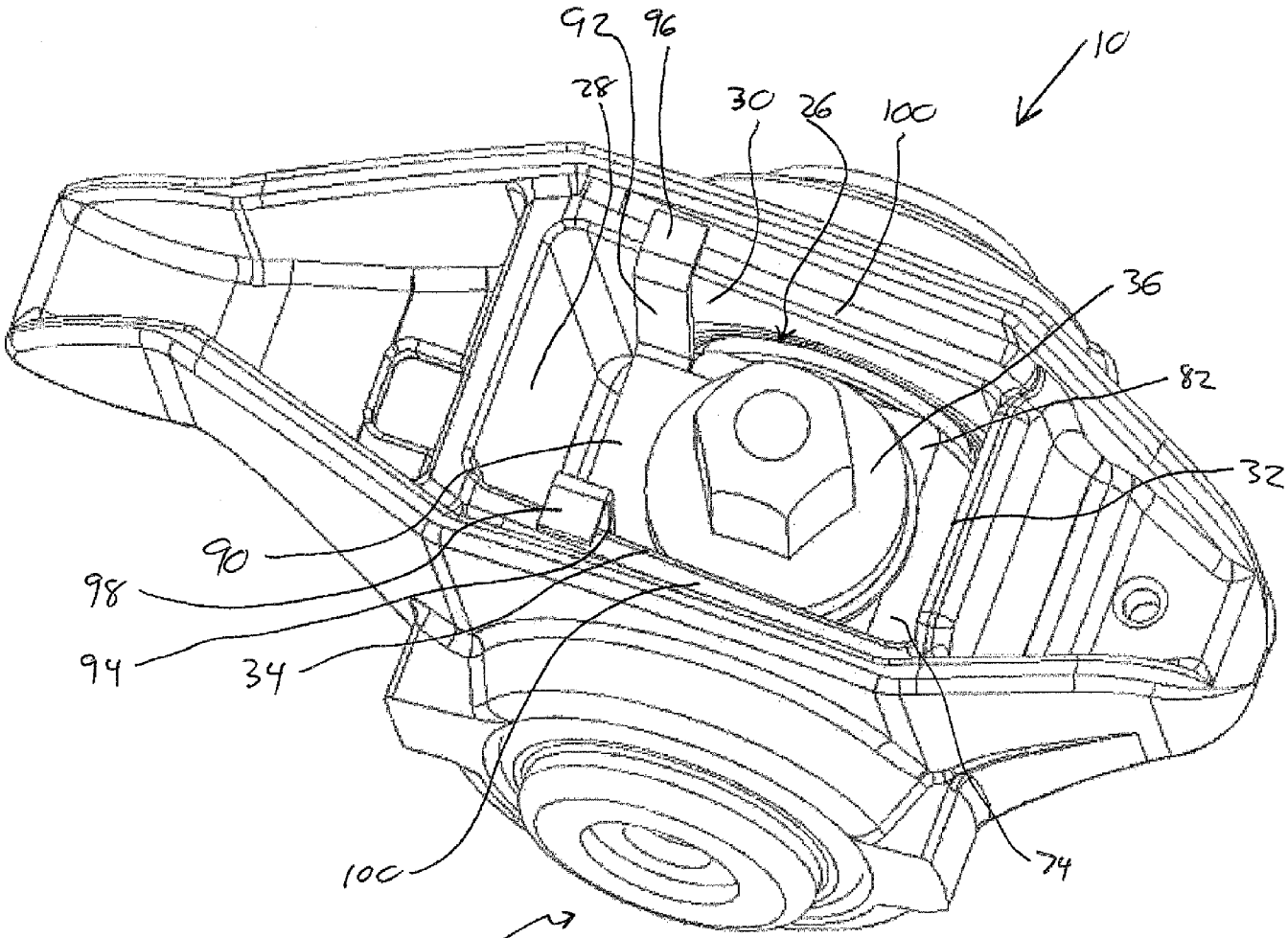
FIG. 15 is a perspective view of the rocker arm assembly with an alternative embodiment of the anti-inversion plate installed in the rocker arm assembly.

FIG. 15 illustrates a perspective view of another plate 82, installed in the rocker arm assembly 10. The plate 82 is installed in the bore 72 of the support pin 74 and prevents the support pin 74 from inverting by contacting one or more of the walls 28, 30, 32, 34 of the central opening 26. Additionally, the fastening bolt 36 can be installed in a hole 84 of the plate 82 and the bore 72 of the support pin 74.

Figure 16:
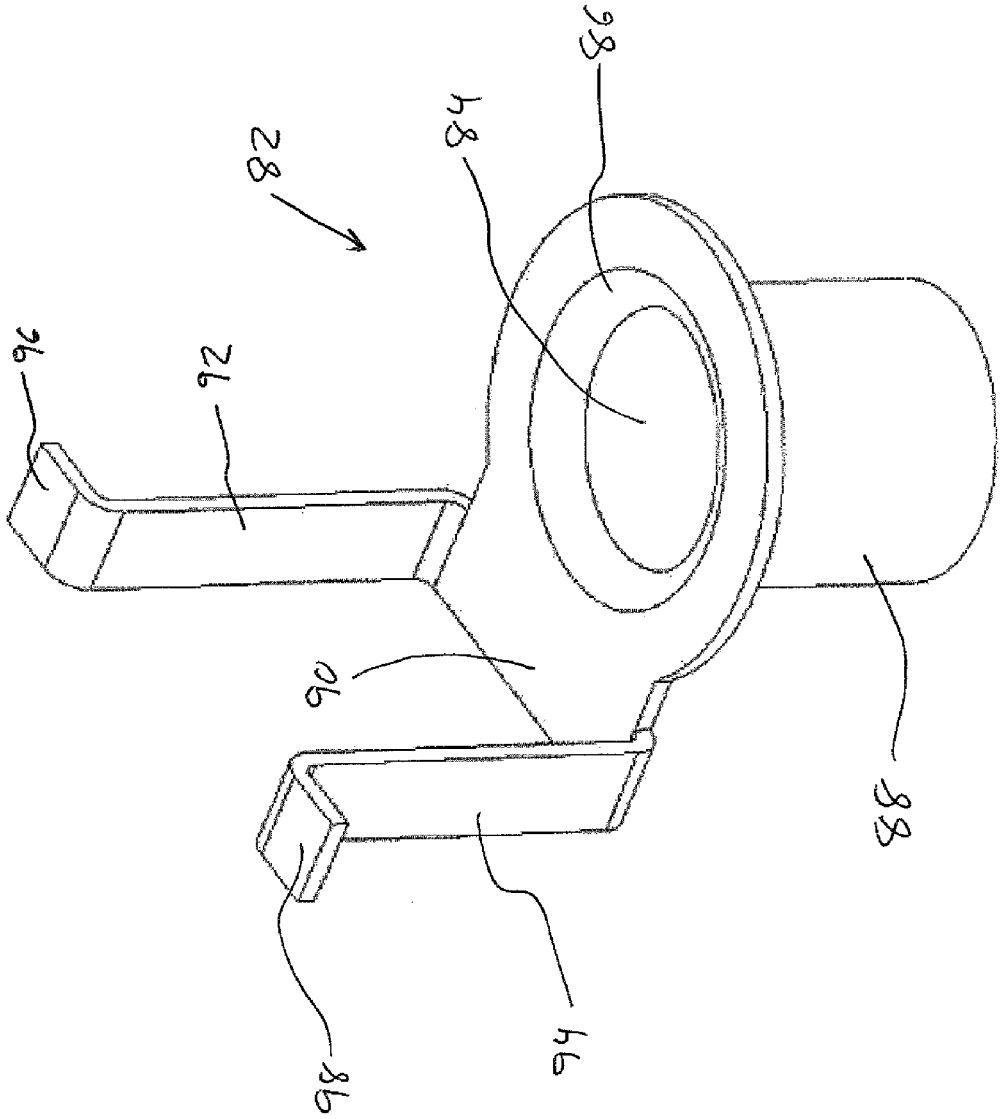
FIG. 16 is a perspective view of the alternate embodiment plate.

FIG. 16 illustrates a perspective view of the plate 82. The plate 82, as shown, is predominately circular and has a hole 84 that is beveled 86 connected to a hollow extension 88, which is fixed in the bore 72 of the support pin 74. The plate 82 also has a tab 90 protruding from the predominately circular shape. Extending vertically from transverse ends of the tab 90 are two flanges 92, 94. Each flange 92, 94 has a finger 96, 98 that is contactable with the rocker arm 14. The fingers 96, 98 may, for example, contact an oil rail 100 on a top are of the rocker arm 14. Alternatively, the plate 82 can also utilize only one flange 92 or 94 and one finger 96 or 98 on one side of the tab 90. Further, alternatively the flanges 92, 94 and fingers 96, 98 can extend from an axial end of the tab 90.

Figure 17:
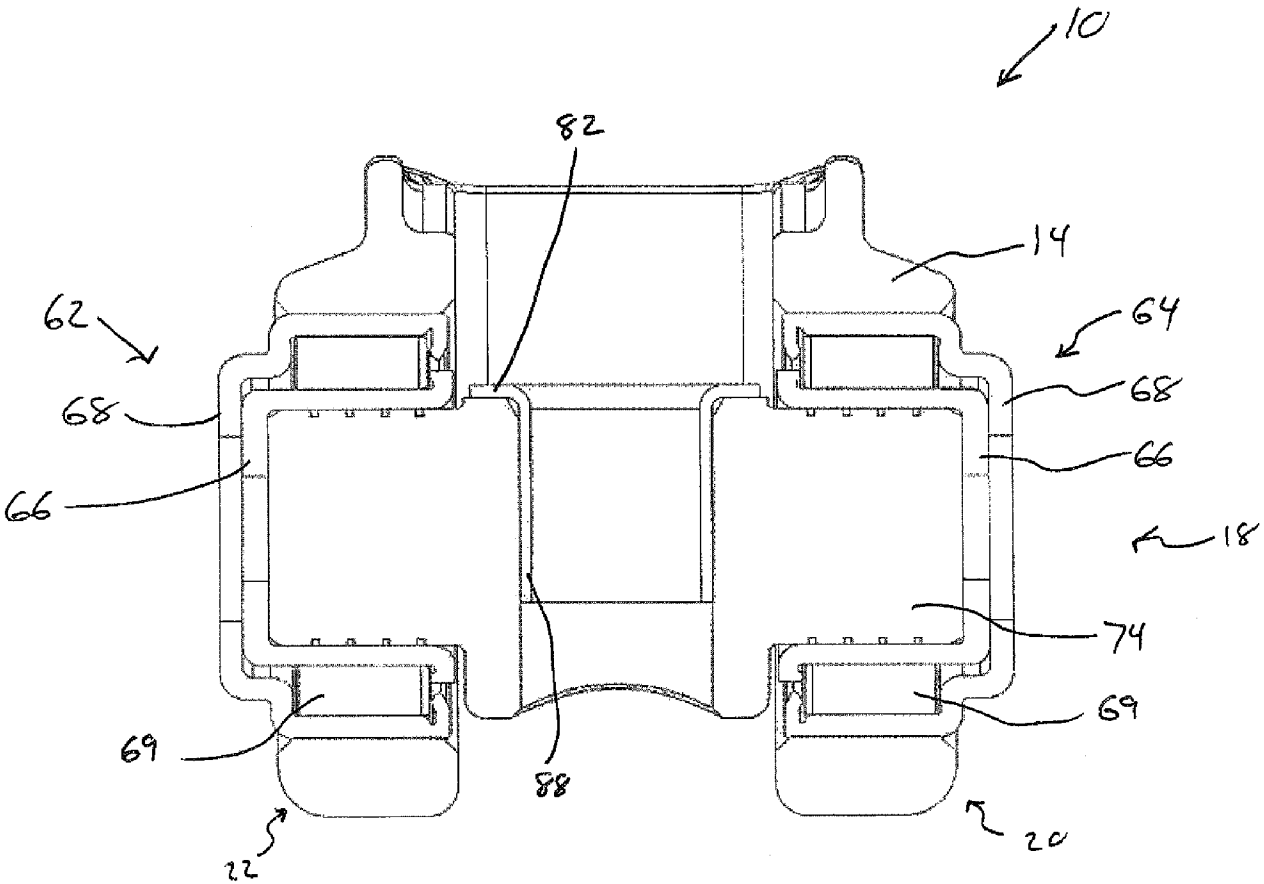
FIG. 17 is a transverse cross-sectional view of the rocker arm assembly with the plate of FIG. 16 in an installed state.

FIG. 17 illustrates a cross-sectional view of the rocker arm assembly 10 with the plate 82 installed. As shown, bearings 62, 64 are positioned at each axial end of the support pin 74 with an inner sleeve 66, an outer sleeve 68, and rolling elements 69 positioned between the inner sleeve 66 and the outer sleeve 68.

Figure 18:
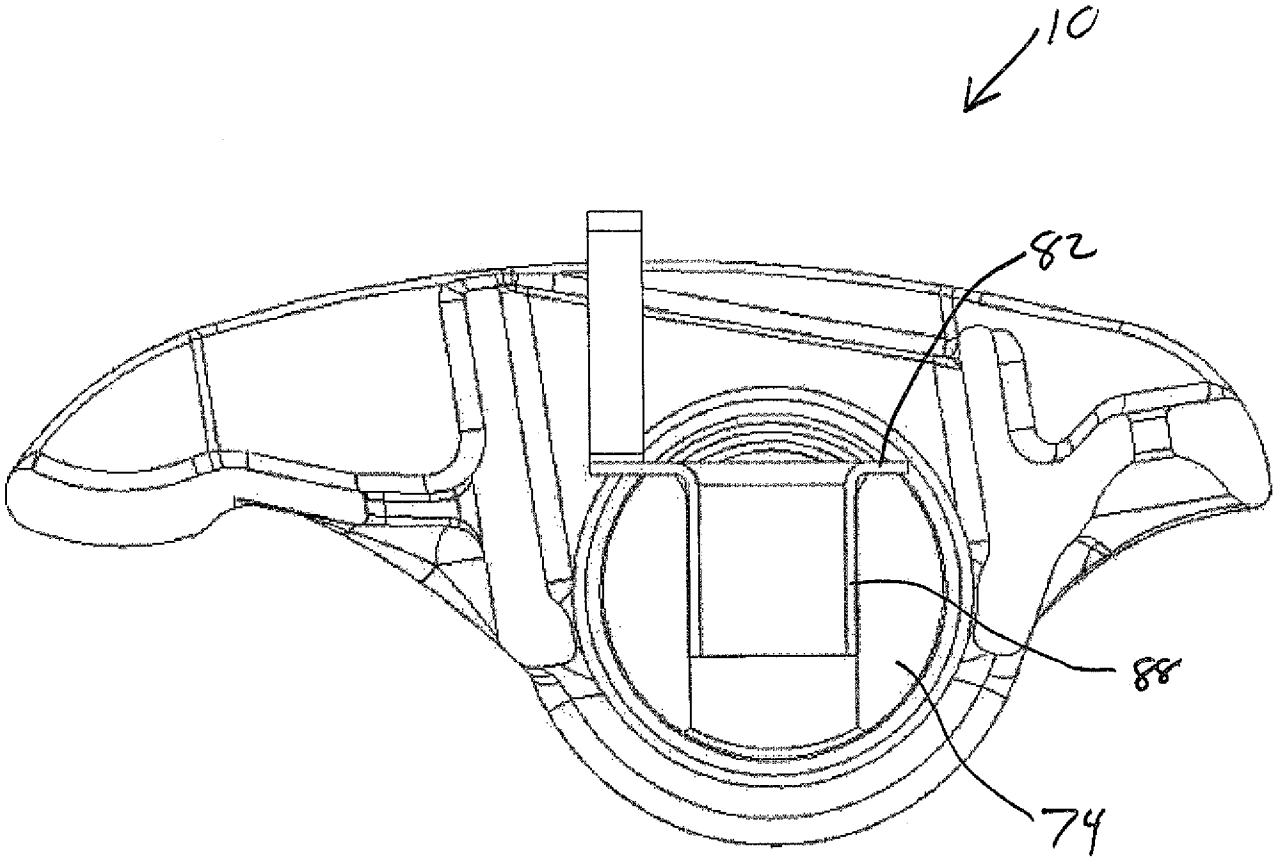
FIG. 18 is a side cross-sectional view illustrating the plate of FIG. 16 installed in the rocker arm assembly.

Similarly, FIG. 18 illustrates a side cross-sectional view of the plate 82 installed in the rocker arm assembly 10.

Figure 19:
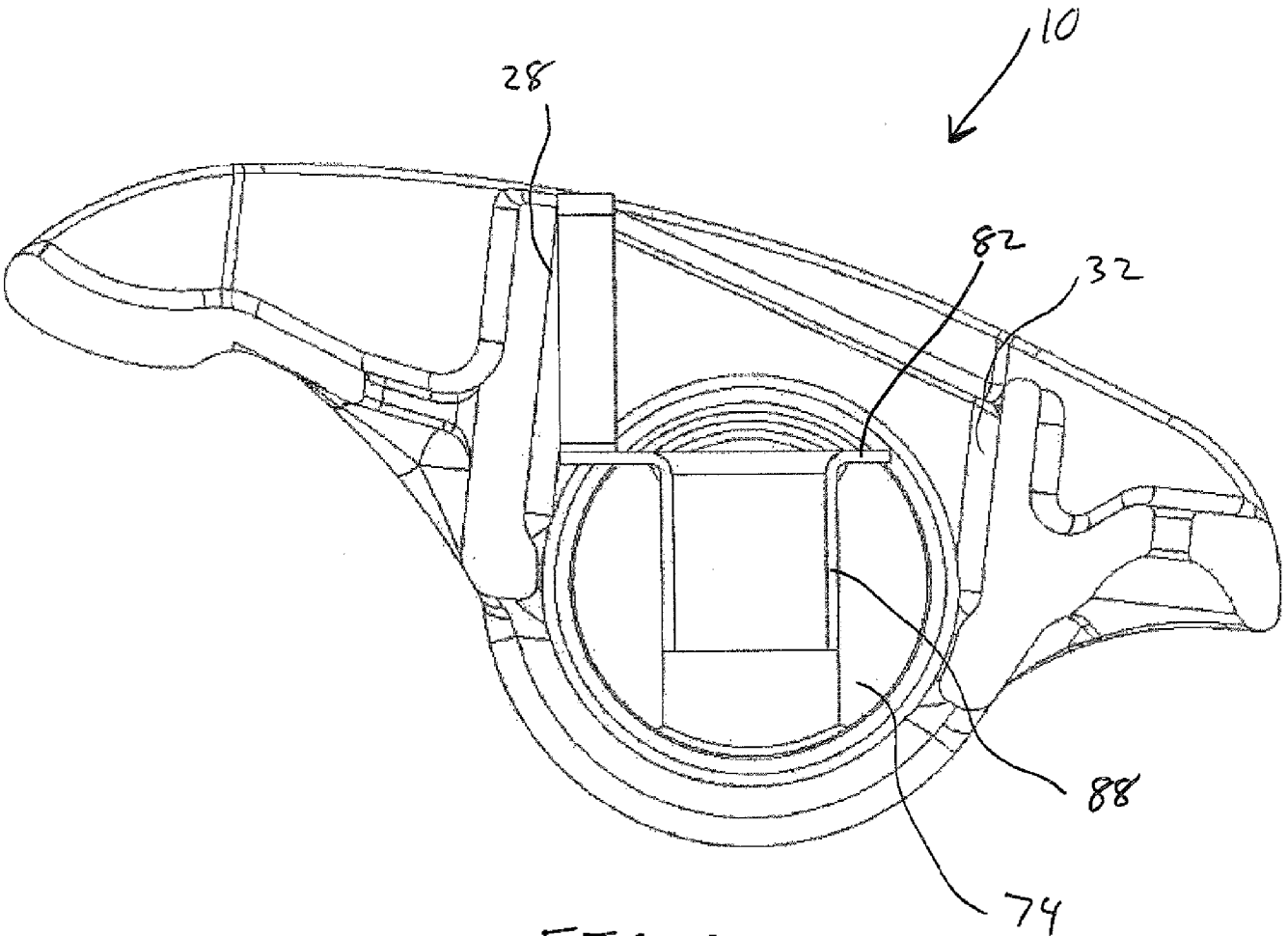
FIG. 19 is a side cross-sectional view illustrating the plate of FIG. 16 installed in the rocker arm assembly with the plate contacting one of the walls of the rocker arm.
Figure 20:
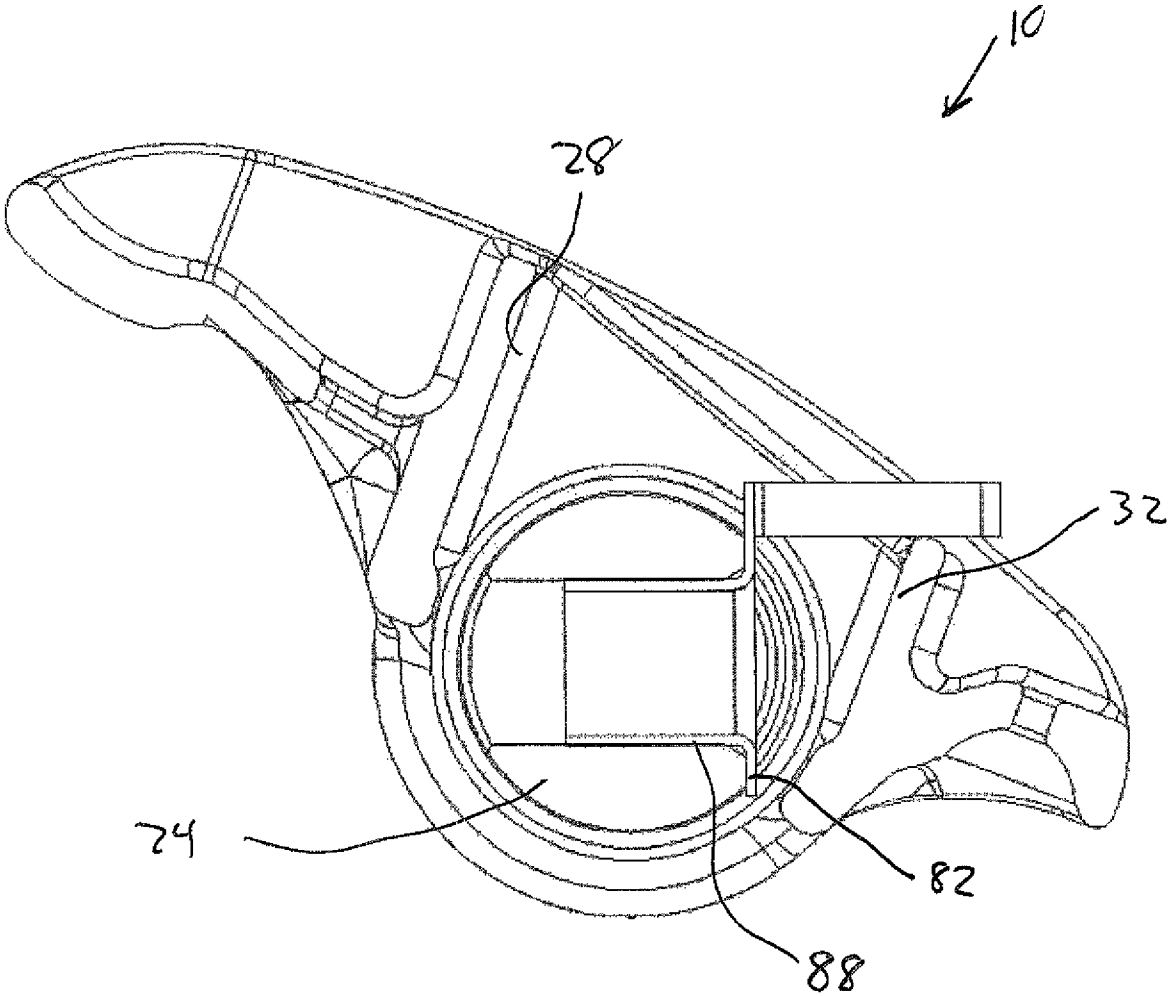
FIG. 20 is a side cross-sectional view illustrating the plate of FIG. 16 installed in the rocker arm assembly with the plate contacting a wail of the rocker arm opposite the wall that the plate contacted in FIG. 19.

FIGS. 19-20 each illustrate the plate 82 contacting at least one of the walls 28, 30, 32, 34 of the rocker arm 14 when the rocker arm 14 is in motion, which prevents the support pin 74 from inverting.

Figure 21:
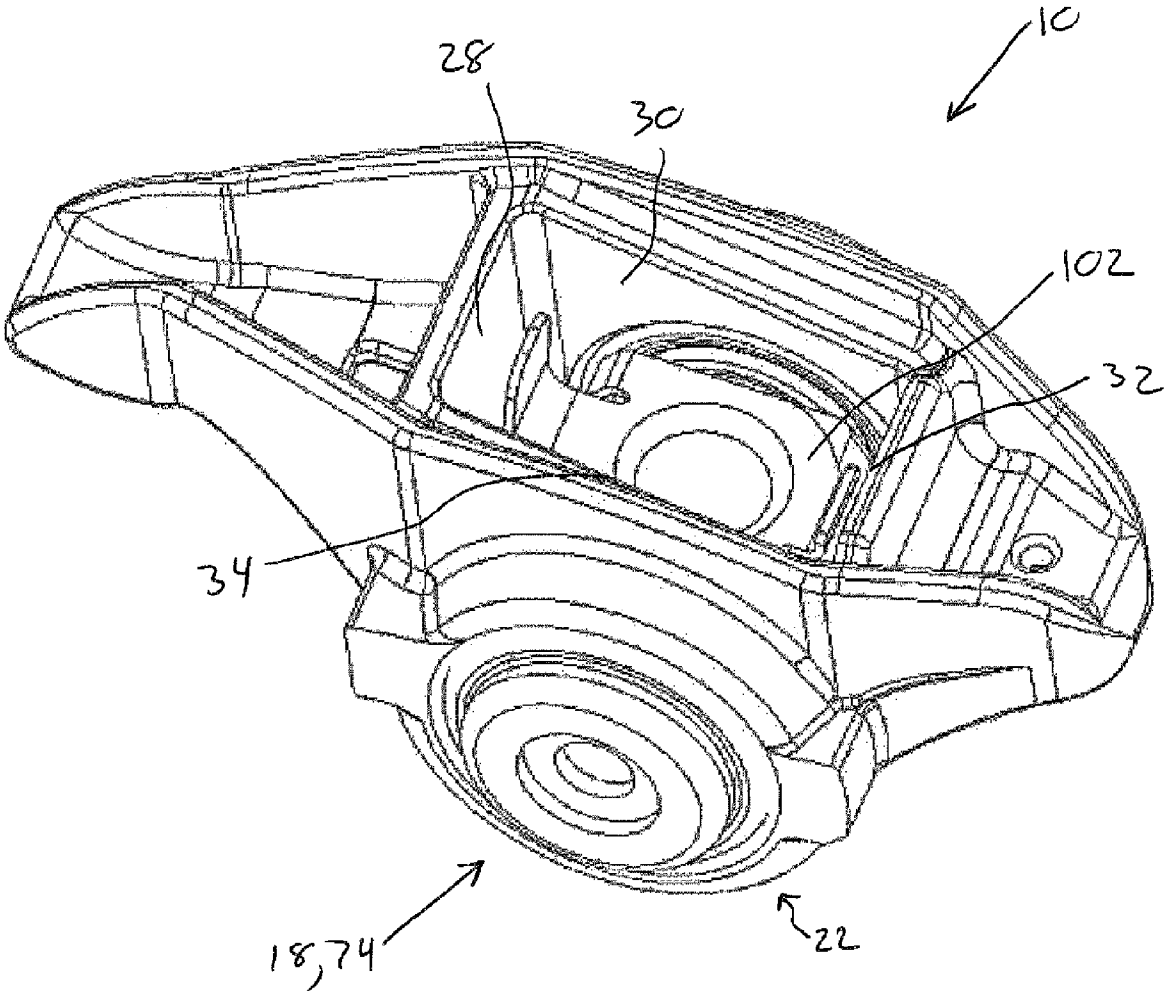
FIG. 21 is a perspective view of the rocker arm assembly with a further alternative embodiment of the anti-inversion plate in an installed state.
Figure 22:
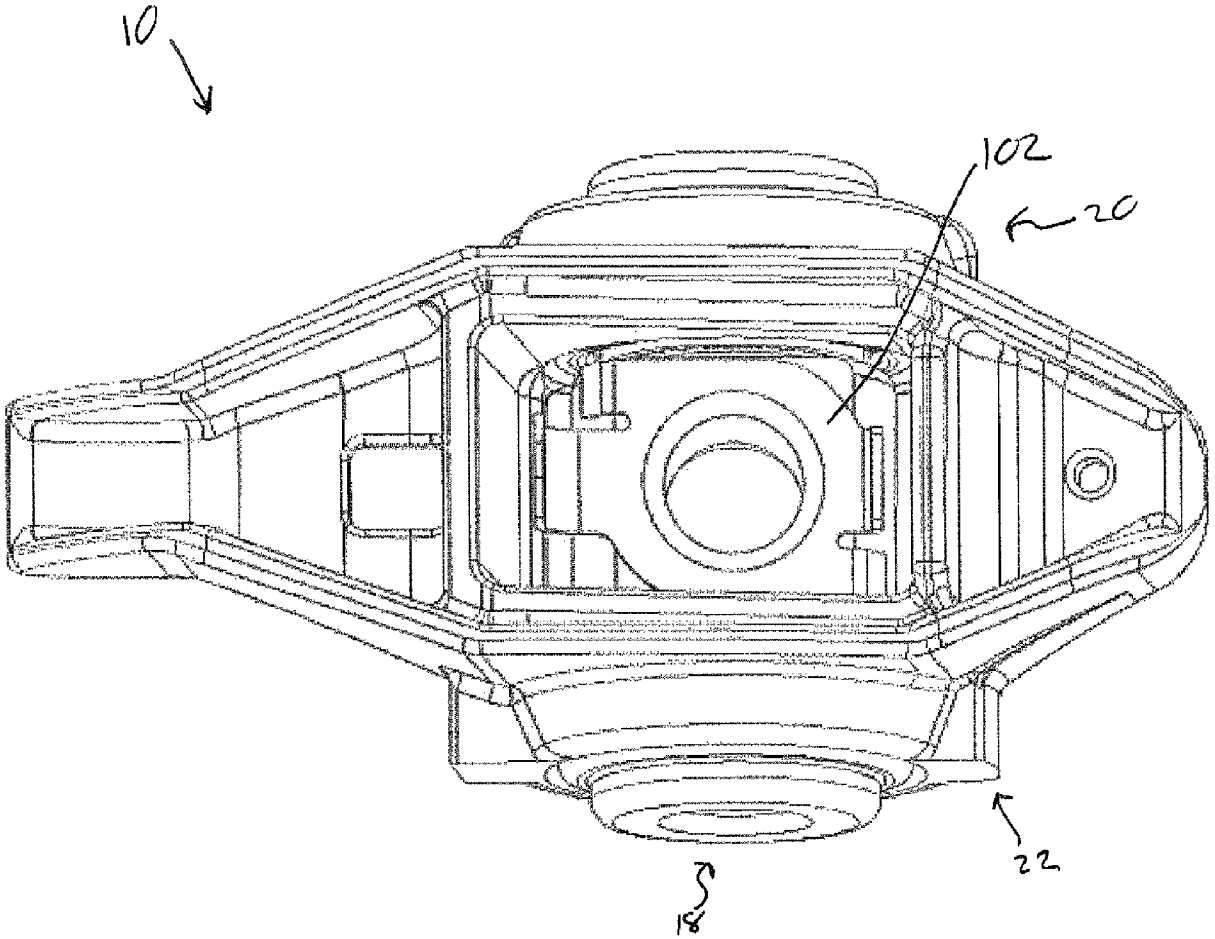
FIG. 22 is a top view of the further alternate embodiment of the plate in FIG. 21 installed in the rocker arm assembly.

FIGS. 21-22 illustrates a perspective view and a top view, respectively, of yet another plate 102, installed in the rocker arm assembly 10. The plate 102 is installed in the bore 72 of the support pin 74 and prevents the support pin 74 from inverting by contacting either the first wall 28 or the third wall 32 of the central opening 26. Additionally, the fastening bolt 36 can be installed in a hole 104 of the plate 102 and bore 72 of the support pin 74.

Figure 23:
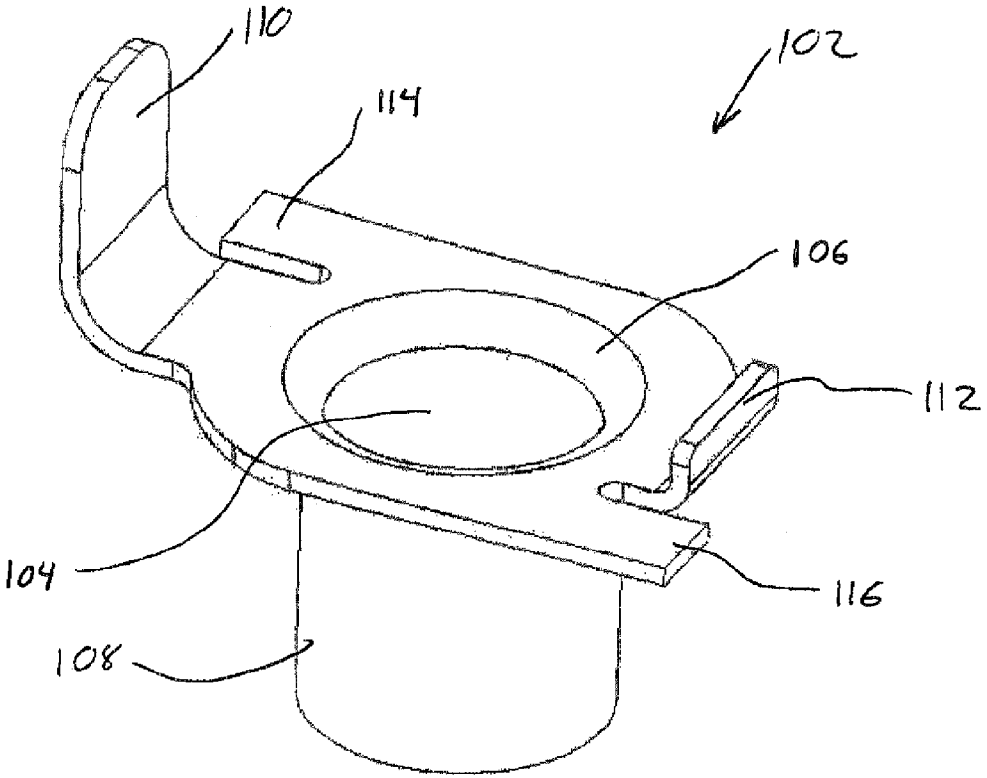
FIG. 23 is a perspective view of the further alternate embodiment plate.

FIG. 23 illustrates a perspective view of the plate 102. The plate 102 has a hole 104 that is beveled 106 connected to a hollow extension 108, which is fixed in the bore 72 of the support pin 74. The plate 102 further has flanges 110, 112 protruding in a predominately vertical direction from opposing sides of the plate 102. The plate also includes tabs 114, 116 adjacent to each flange 110, 112 and oppose each other diagonally. The tabs 114, 116 are bendable to aid in securing the plate 102 to the support pin 74.

Figure 24:
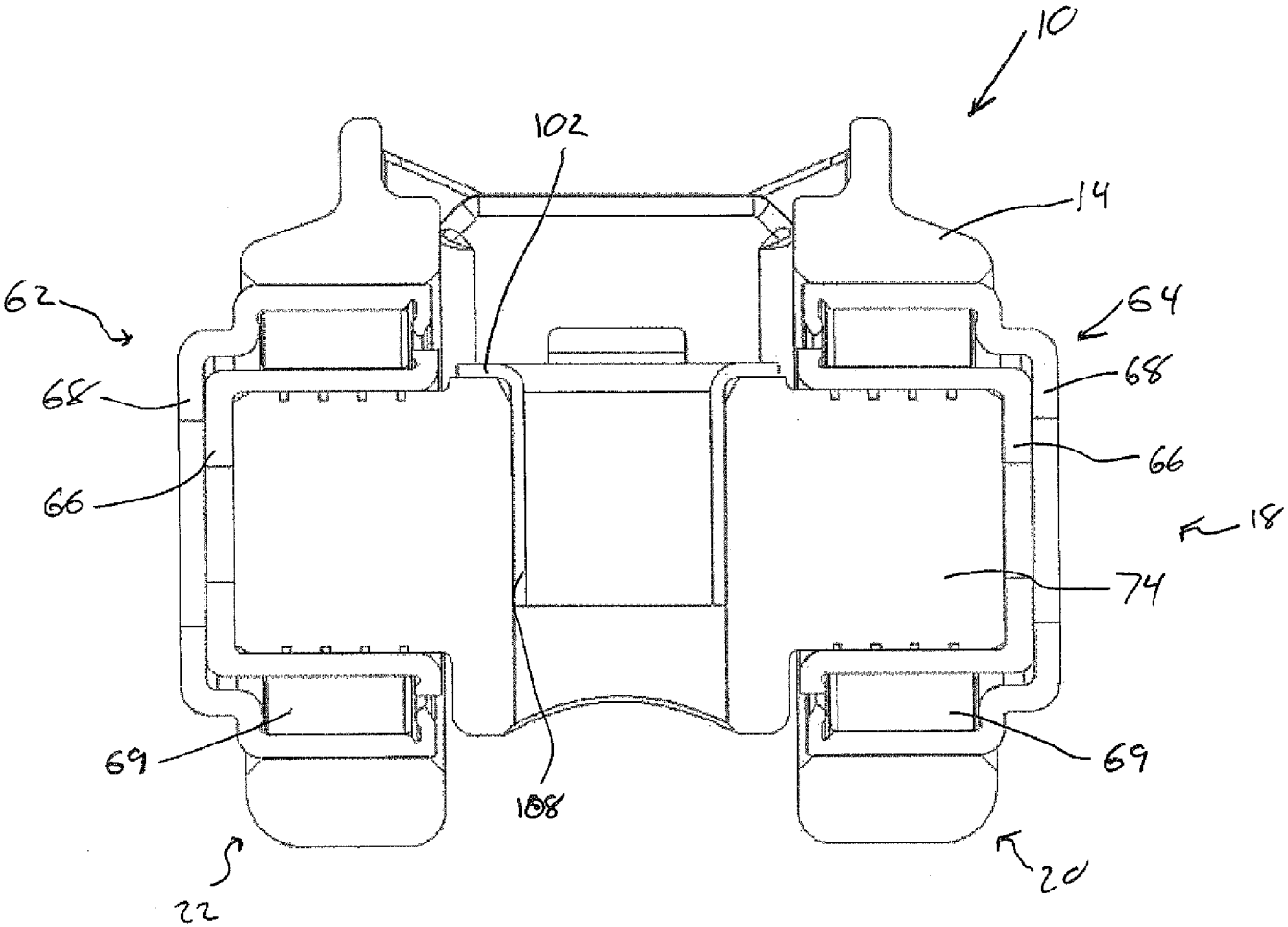
FIG. 24 is a transverse cross-sectional view of the rocker arm assembly with the plate of FIG. 23 in an installed state.

FIG. 24 illustrates a cross-sectional view of the rocker arm assembly 10 with the plate 102 installed. As shown, bearings 62, 64 are positioned at each axial end of the support pin 74 with an inner sleeve 66, an outer sleeve 68 and rolling elements 69 positioned between the inner sleeve 66 and the outer sleeve 68.

Figure 25:
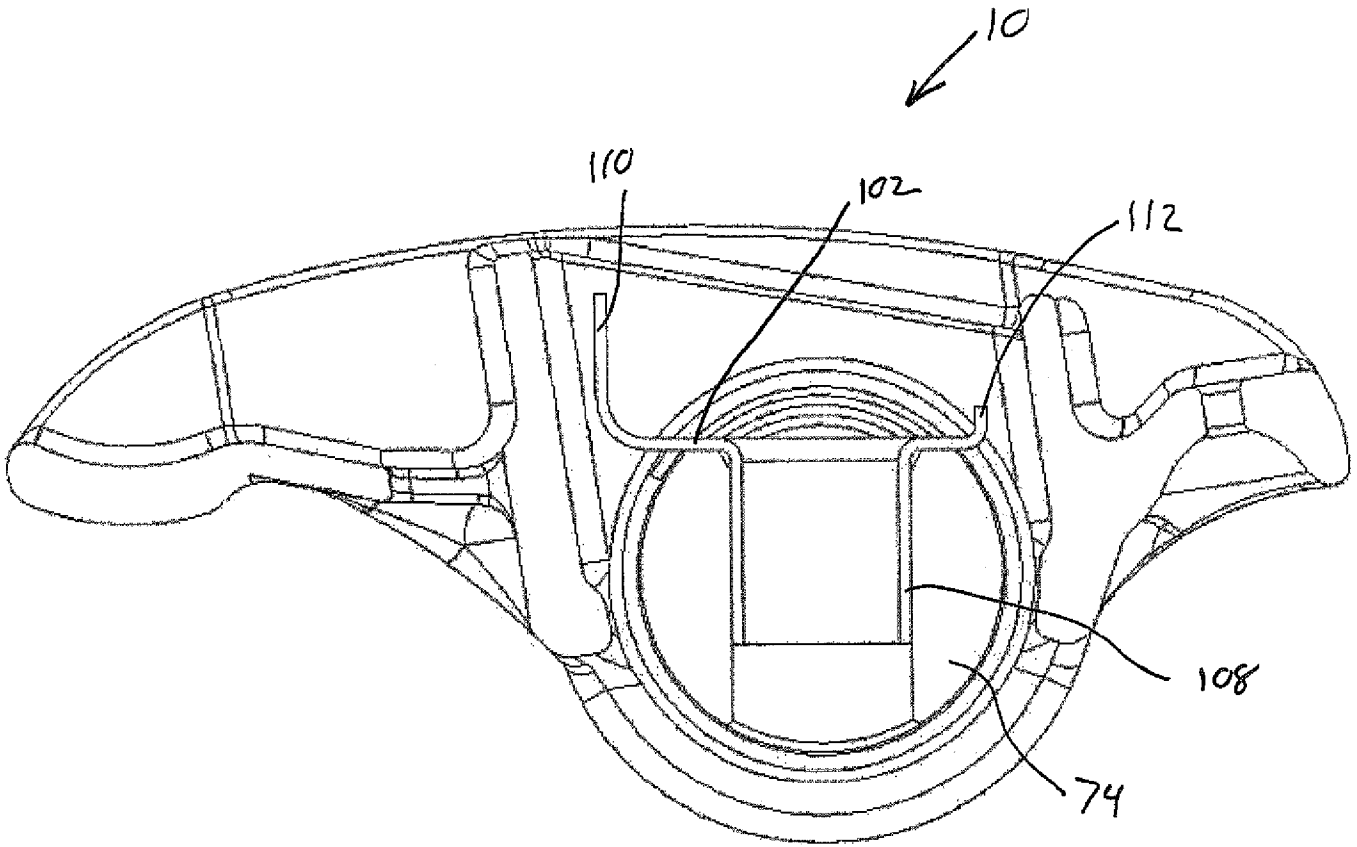
FIG. 25 is a side cross-sectional view illustrating the plate of FIG. 23 installed in the rocker arm assembly.

FIG. 25 illustrates a side cross-sectional view of the plate 102 installed in the rocker arm assembly 10.

Figure 26:
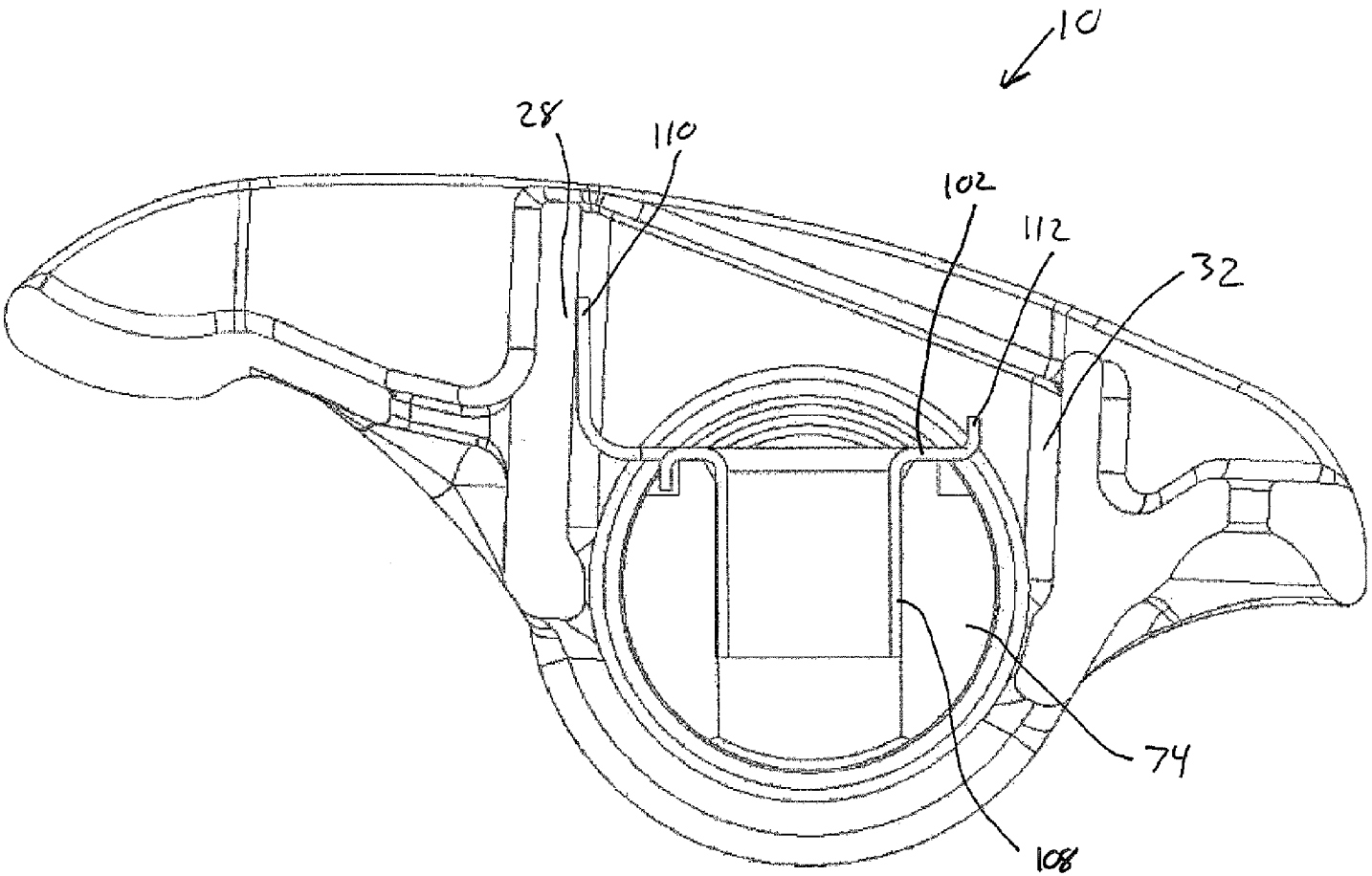
FIG. 26 is a side cross-sectional view illustrating the plate of FIG. 23 installed in the rocker arm assembly with the plate contacting one of the walls of the rocker arm.
Figure 27:
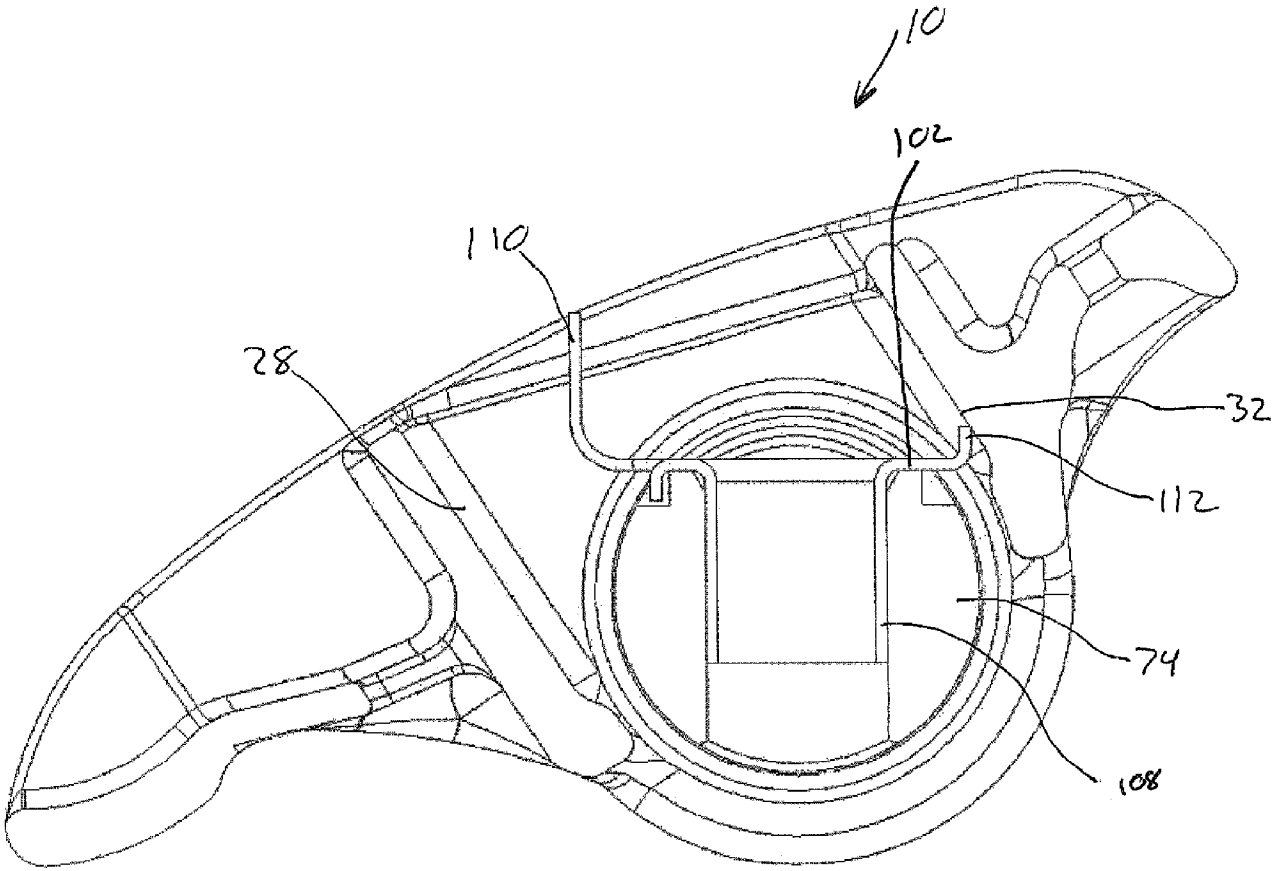
FIG. 27 is a side cross-sectional view illustrating the plate of FIG. 23 installed in the rocker arm assembly with the plate contacting a wall of the rocker arm opposite the wall that the plate contacted in FIG. 26.

FIGS. 26-27 each illustrate the plate 102 contacting one of the walls 28, 32 of the rocker arm 14 when the rocker arm 14 is in motion, which prevents the support pin 74 from inverting.

Figure 28:
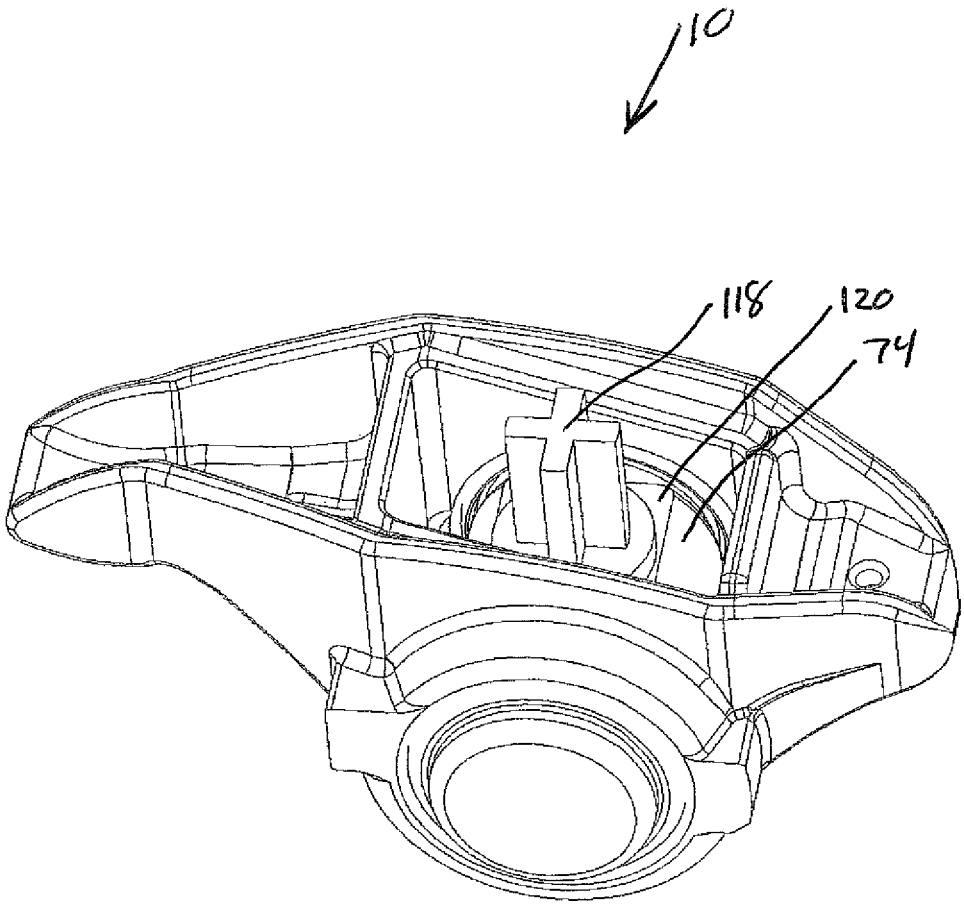
FIG. 28 is a perspective view of an anti-inversion plug installed in the rocker arm assembly.

FIG. 28 illustrates a perspective view of the rocker arm assembly 10 with a plug 118 installed in the bore 72 of the support pin 74. The bore 72 is positioned in a central opening 26 in the rocker arm 14 on a flat section 120 of the support pin 74.

Figure 29:
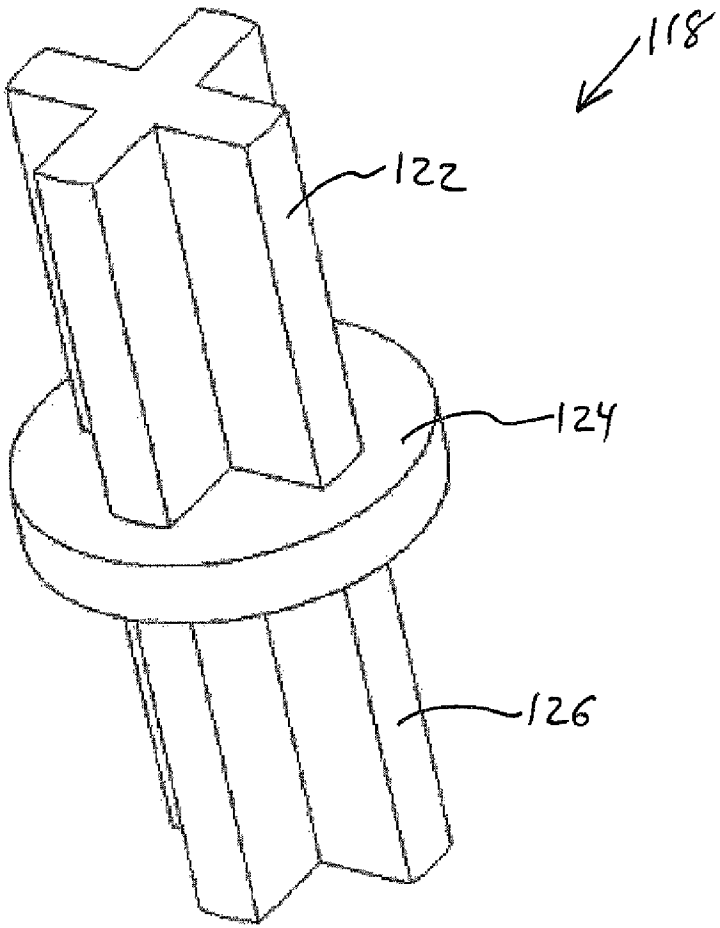
FIG. 29 is a perspective view of the plug.

As shown in FIG. 29, the plug 118 has an upper section 122, a central section 124, and a lower section 126. As illustrated, the upper section 122 and the lower section 126 resemble an X-shaped or a plus symbol. The central section 124, which connect the upper section 122 and the lower section 126, takes the shape of a circular disk. However, the upper section 124, the lower section 126 and the central section 124 can each resemble any desired shape.

Figure 30:
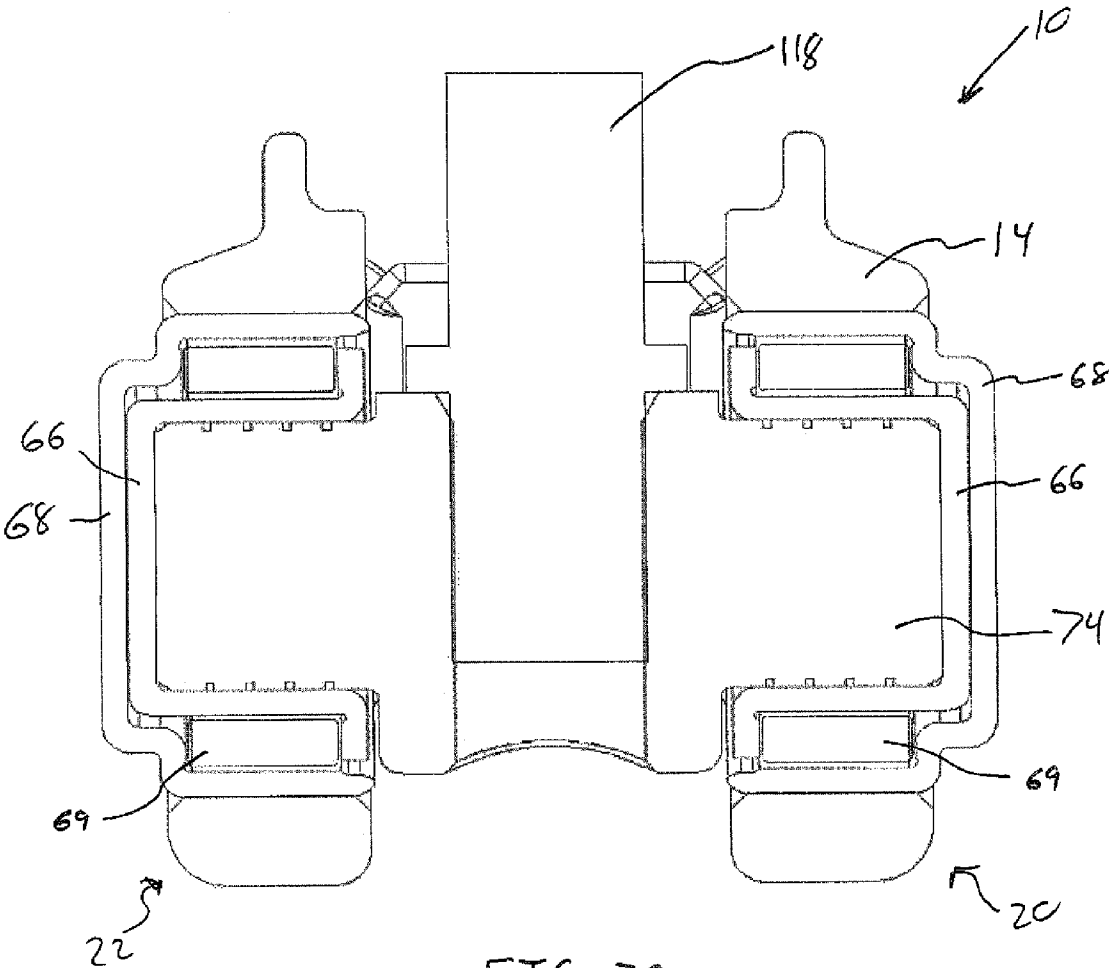
FIG. 30 is a transverse cross-sectional view of the rocker arm assembly with the plug in an installed state.

FIG. 30 illustrates a cross-sectional view of the rocker arm assembly 10 with the plug 118 installed in the bore 72 of the support pin 74. The lower section 126 is press fit in the bore 72 of the support pin 74, the central section 124 rests on the support pin 74 to keep the plug 118 located vertically on the support pin 74 and the upper section 122 extends vertically from the central section 124 and is contactable upon movement of the rocker arm 14 with walls in a central opening 124 of the rocker arm 14, preventing inversion of the support pin 74. As shown, bearings 62, 64 are positioned at each axial end of the support pin 74 with an inner sleeve 66, an outer sleeve 68, and rolling elements 69 positioned between the inner sleeve 66 and the outer sleeve 68.

Figure 31:
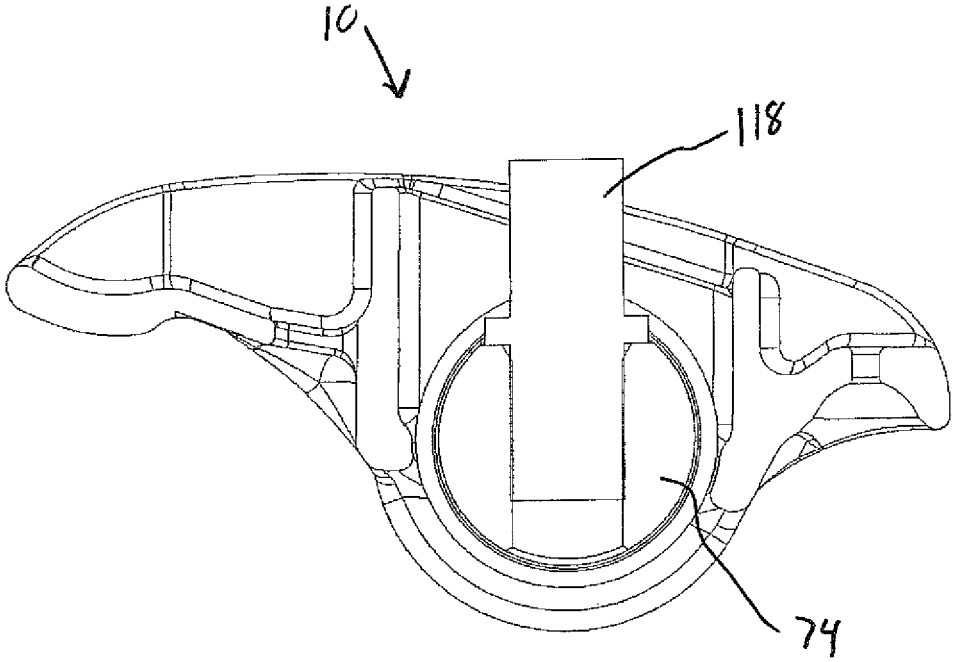
FIG. 31 is a side cross-sectional view illustrating the plug installed in the rocker arm assembly.

FIG. 31 illustrates a side cross-sectional view of the rocker arm assembly 10 with the plug 118 installed in the bore 72 of the support pin 74.

Figure 32:
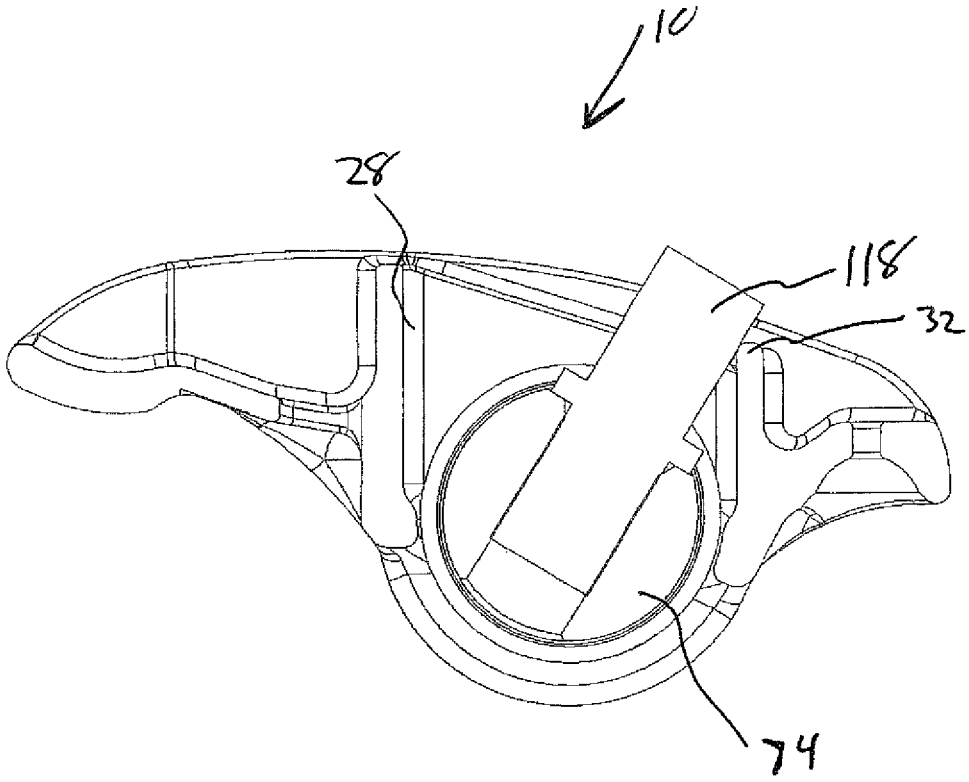
FIG. 32 is a side cross-sectional view illustrating the plug contacting one of the walls of the rocker arm.

FIG. 32 illustrates a side cross-sectional view of the rocker arm assembly 10 with the plug 118 installed in the bore 72 of the support pin 74 in rotation. As shown, the upper section 122 of the plug 118 prevents the support pin 74 from inverting by contacting one of the walls 28, 32 or the central opening 26 in the rocker arm 14.

Figure 33:
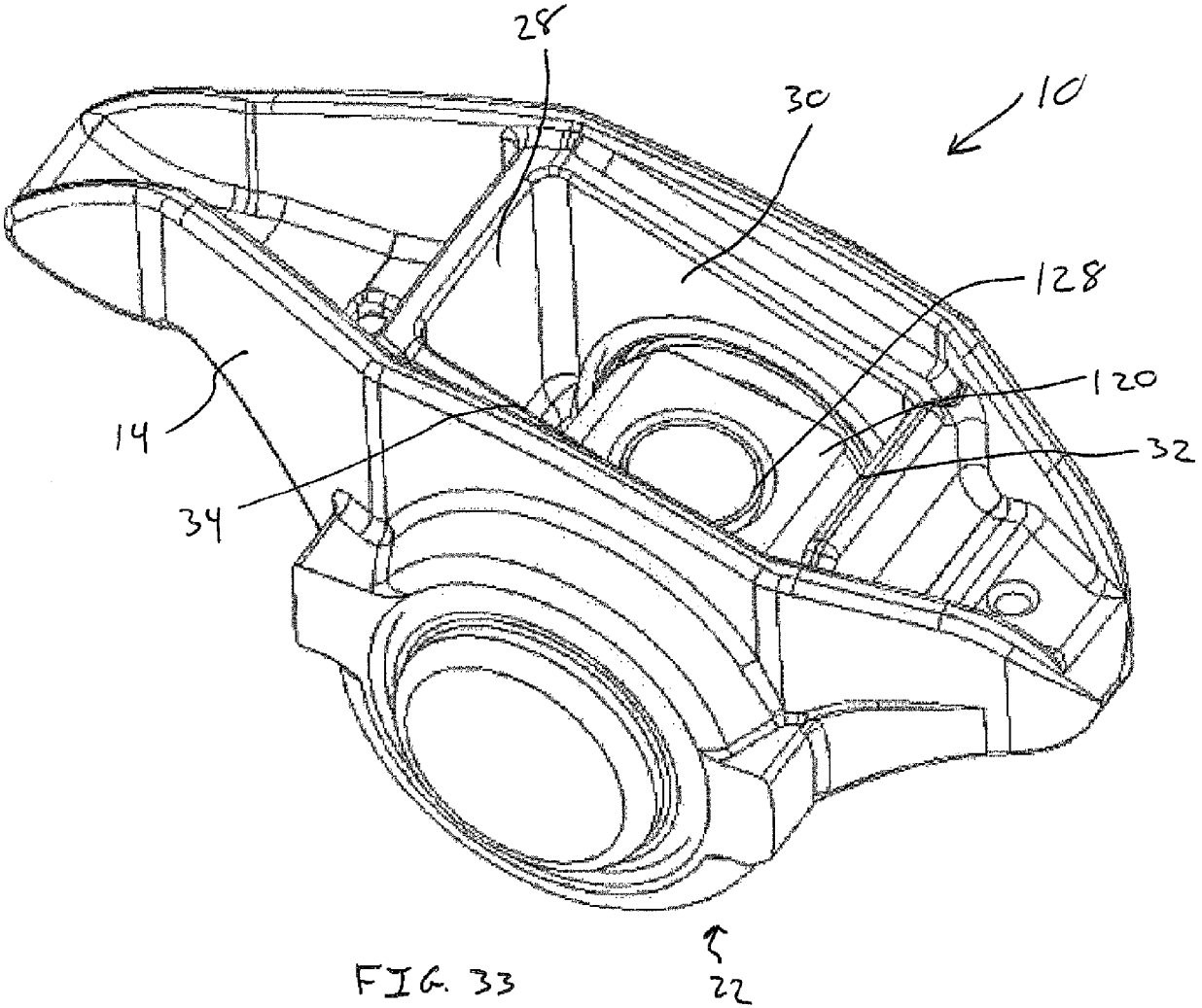
FIG. 33 is a perspective view of an anti-inversion sleeve installed in the rocker arm assembly.

FIG. 33 illustrates a perspective view of the rocker arm assembly 10 with a sleeve 128 installed in the bore 72 of the support pin 74. The bore 72 is located in a central opening 26 in the rocker arm 14 on the flat section 120 of the support pin 72.

Figure 34:
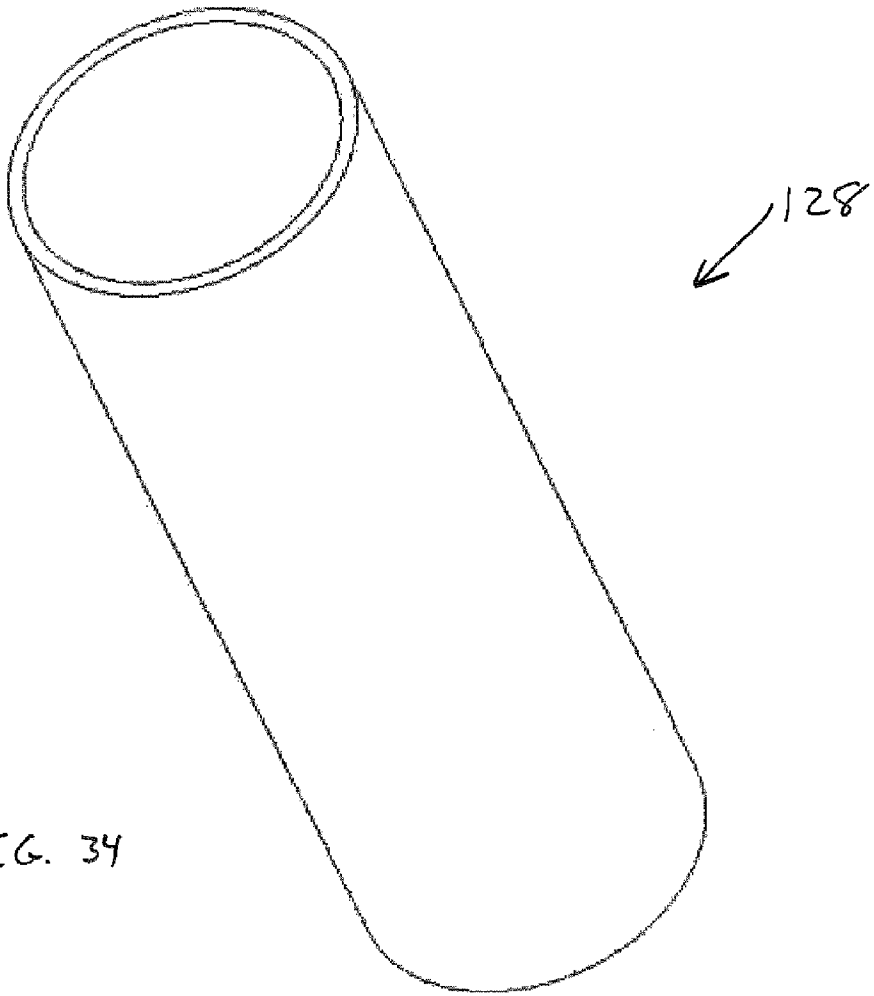
FIG. 34 is a perspective view of the sleeve.

As shown in FIG. 34, the sleeve 128 is hollow and has a nominal wall thickness.

Figure 35:
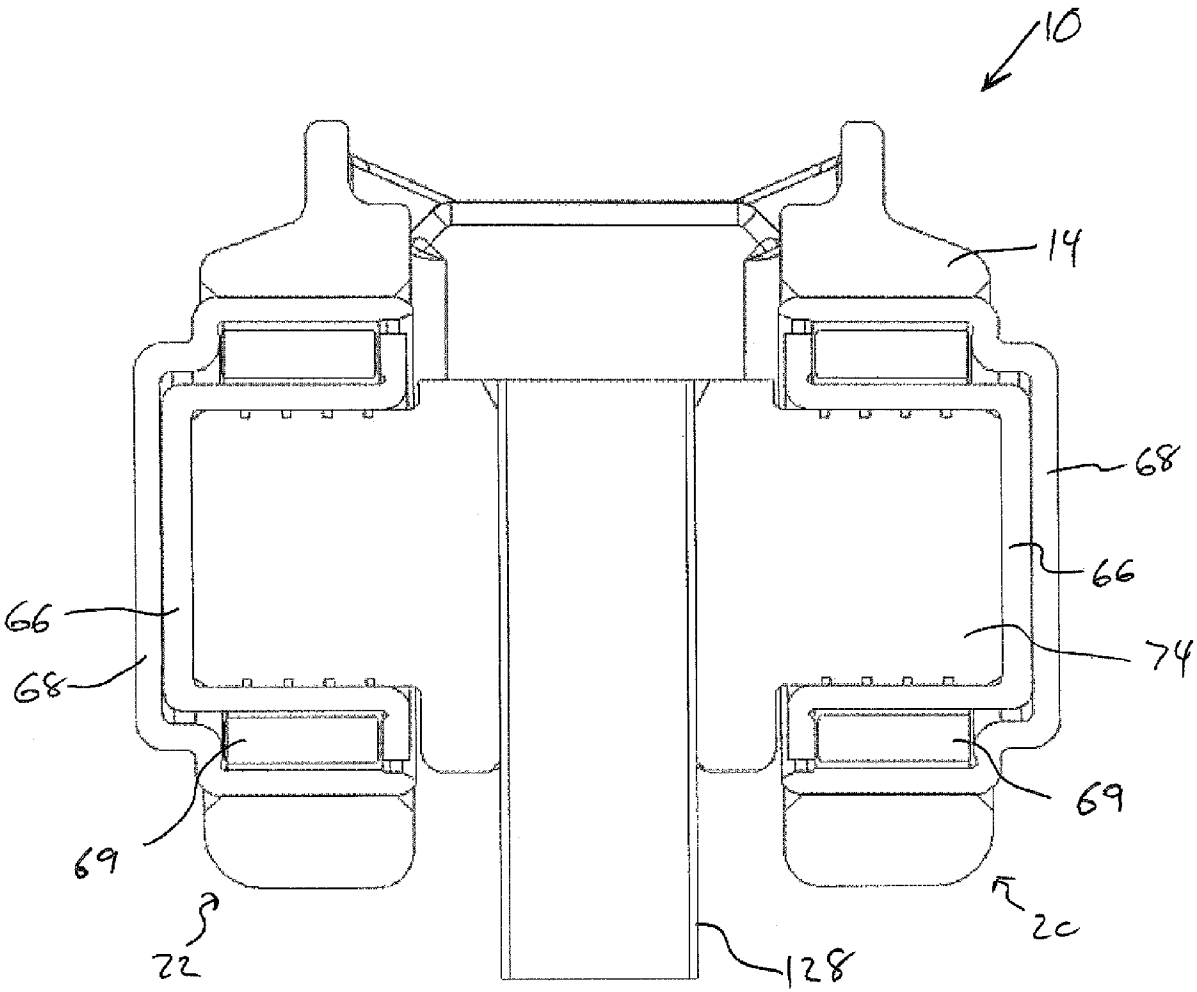
FIG. 35 is a transverse cross-sectional view of the rocker arm assembly with the sleeve in an installed state.

FIG. 35 illustrates a cross-sectional view of the rocker arm assembly 10 with the sleeve 128 press fit in the bore 72 of the support pin 74. The sleeve 128 extends beyond the support pin 74 and rocker arm 14, and is contactable upon movement of the rocker arm 14 with bottom walls 130 of the rocker arm 14, preventing inversion of the support pin 72. As shown, bearings 62, 64 are positioned at each axial end of the support pin 16 with an inner sleeve 66, an outer sleeve 68, and rolling elements 69 positioned between the inner sleeve 66 and the outer sleeve 68.

Figure 36:
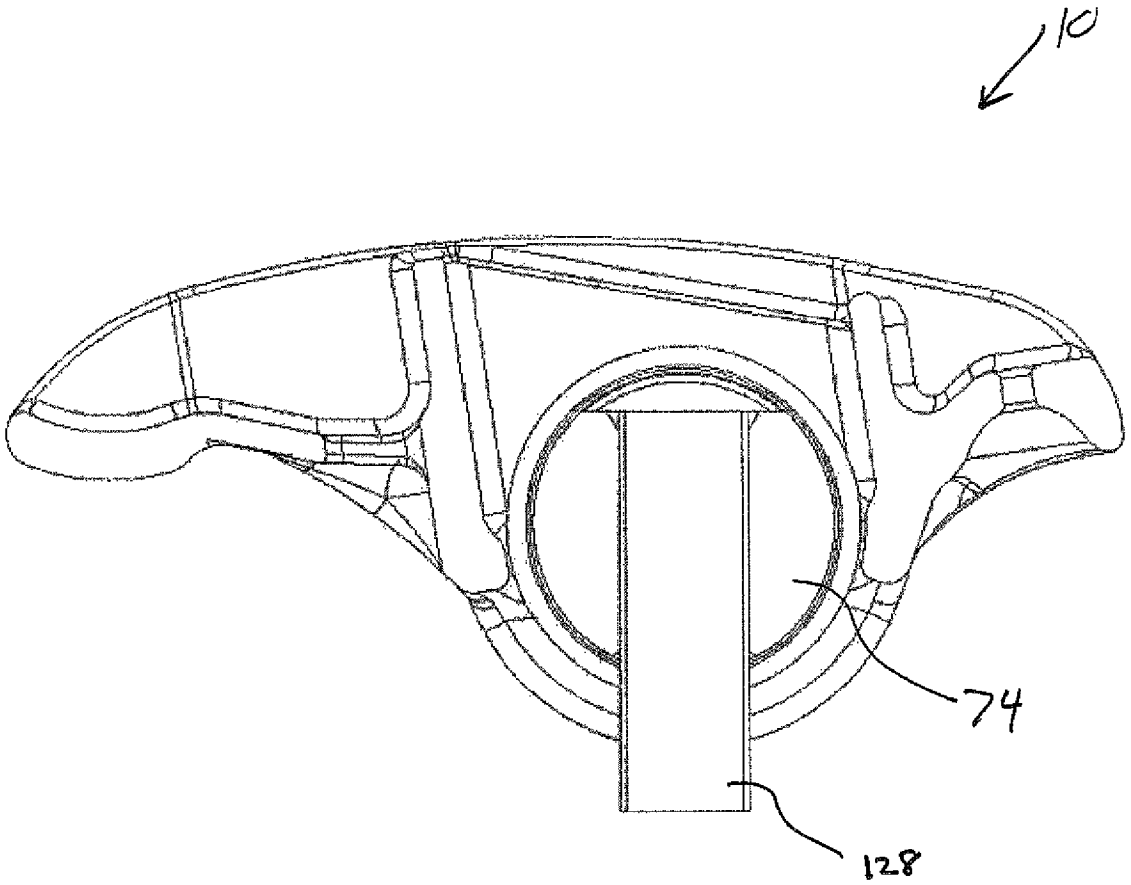
FIG. 36 is a side cross-sectional view illustrating the sleeve installed in the rocker arm assembly.

FIG. 36 illustrates a side cross-sectional view of the rocker arm assembly 10 with the sleeve 128 installed in the bore 72 of the support pin 74.

Figure 37:
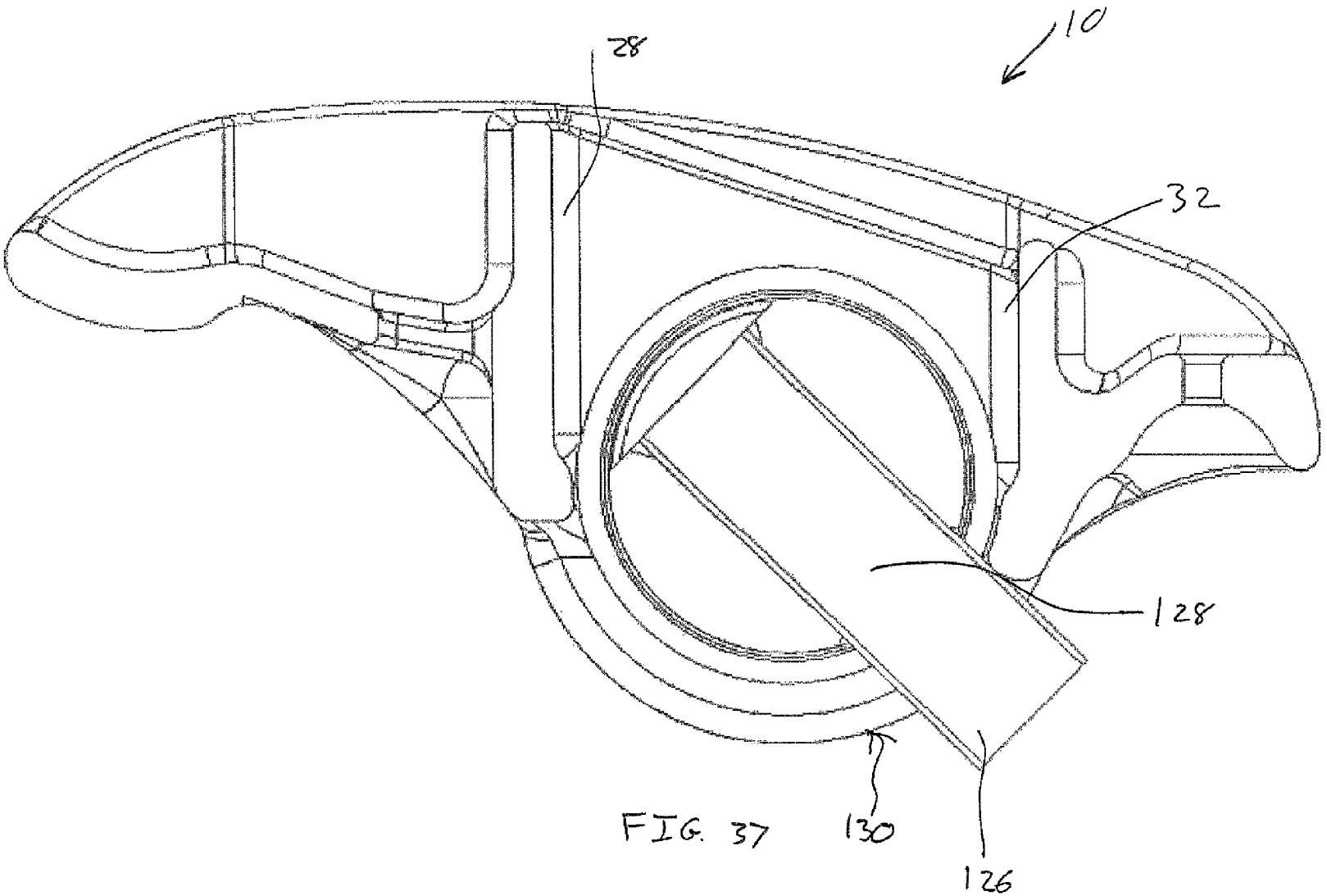
FIG. 37 is a side cross-sectional view illustrating the sleeve contacting one of the bottom walls of the rocker arm.

FIG. 37 illustrates a side cross-sectional view of the rocker arm assembly 10 with the sleeve 128 installed in the bore 72 of the support pin 74 and the support pin 72 in rotation. As shown, the lower section 126 of the sleeve 128 prevents the support pin 72 from inverting by contacting one of the bottom walls 130 of the rocker arm 14.

REFERENCE CHARACTERS

10 Rocker Arm Assembly
12 Washer
14 Rocker Arm
16 Support Pin
18 Through-hole
20 Side Wall
22 Side Wall
24 Bore
26 Central Opening
28 First Wall
30 Second Wall
32 Third Wall
34 Fourth Wall
36 Fastening Bolt
38 Flat Top
40 Beveled Edge
42 Beveled Edge
44 Concave Bottom
46 Beveled Edge
48 Central Section
49 Central Section
50 End
52 End
54 Beveled Surface
56 Beveled Surface
58 Beveled Surface
60 Stepped Surface
62 Bearing
64 Bearing
66 Inner Sleeve
68 Outer Sleeve
69 Rolling Elements
70 Plate
72 Bore
74 Support Pin
76 Hole
78 Beveled Surface
80 Extension
82 Plate
84 Hole
86 Beveled Surface
88 Extension
90 Tab
92 Flange
94 Flange

96 Finger
98 Finger
100 Oil Rail
102 Plate
104 Hole
106 Beveled Surface
108 Extension
110 Flange
112 Flange
114 Tab
116 Tab
118 Plug
120 Flat Section
122 Upper Section
124 Middle Section
126 Lower Section
128 Sleeve
130 Bottom Walls

What is claimed:

1. A rocker arm assembly for use in an internal combustion engine, comprising:

a rocker arm having a transverse through-hole and a central opening defined by at least one wall;

a support pin having a body with a centrally located bore, the support pin being positioned in the through-hole and about which the rocker arm rocks;

a bearing positioned at each end of the support pin in the through-hole between the support pin and the rocker arm; and an anti-inversion part affixed in the bore of the support pin, wherein the anti-inversion feature is a plate connected a hollow extension that engages in the bore of the supporting pin, at least a portion of the plate being contactable upon movement of the rocker arm with the at least one wall of the central opening of the rocker arm, preventing inversion of the support pin.

2. The assembly of claim 1, wherein the rocker arm further comprises:

an outer sleeve abutting an inner circumferential wall of the through-hole, and having an outer bearing wall that extends radially inward and covers the through-hole; and an inner sleeve abutting an outer circumferential wall of the support pin, and having an inner bearing wall that extends radially inward and covers an axial end wall of the support pin, the outer bearing wail abutting the inner bearing wall; and rolling elements positioned between and in contact with the inner sleeve and outer sleeve to accommodate radial loads.

3. The assembly of claim 1, wherein the body of the support pin has a flat upper surface and a curved lower surface.

4. The assembly of claim 3, wherein the central opening of the rocker arm is defined by a first wail, a second wall, a third wall and a fourth wall, the first wall the and the third wall facing each other and the second wall and the fourth facing each other and being transverse to the first wall and the third wall.

5. The assembly of claim 4, wherein the plate includes a beveled hole connected to the hollow extension.

6. The assembly of claim 5, wherein the plate is rectangular and, upon movement of the rocker arm, the plate is contactable upon movement of the rocker arm with the first wall, the second wall, the third wall or the fourth wall of the rocker arm.

7. The assembly of claim 5, wherein the plate is predominately circular and has a tab extending in a transverse direction, and the tab has at least one protrusion extending in a generally vertical direction from an axial extending end of the tab and the protrusion has a finger extending in a generally horizontal direction that contacts the rocker arm and an oil rail on a top of the rocker arm.

8. The assembly of claim 4, wherein, in opposite transverse directions, the plate has a first generally extending vertical flange and a second generally extending vertical flange.

9. The assembly of claim 8, wherein the first vertical flange and the second vertical flange are contactable with the first wall or the third wall of the central opening of rocker arm.

10. The assembly of claim 8, wherein the plate has tabs which are bendable downwardly to engage the support pin to prevent the plate from rotating during tightening of a fastening bolt.

11. The assembly of claim 10, wherein the tabs are on opposite sides of the plate, adjacent to the first vertical flange and the second vertical flange and diagonally opposite each other.

12. The assembly of claim 1, wherein the body of the support pin is entirely cylindrical.

13. The assembly of claim 12, wherein the support pin has a central section and two ends, the central section having a smooth, cylindrical surface and the ends, which are located on each side of the central section, being stepped and narrower in diameter than the central section.

14. A rocker arm assembly for use in an internal combustion engine, comprising:

a rocker arm having a transverse through-hole;

a support pin having a body with a centrally located bore, the body of the support pin having a flat upper surface and a curved lower surface, and the support pin being positioned in the through-hole end about which the rocker arm rocks;

a bearing positioned at each end of the support pin in the through-hole between the support pin and the rocker arm; and an anti-inversion part affixed in the bore of the support pin, wherein the anti-inversion feature is a removable plug which has an upper portion, a central portion and a lower portion, wherein the lower portion is press fit in the bore of the support pin, the central portion rests on the support pin to keep the plug located vertically on the support pin and the upper portion extends vertically from the central portion and is contactable upon movement of the rocker arm with walls in a central opening of the rocker arm, preventing inversion of the support pin.

15. The assembly of claim 14, wherein the upper portion and the lower portion are each X-shaped or shaped in the form of a plus sign and the central portion is a circular disk located between the upper portion and the lower portion.

16. A rocker arm assembly for use in an internal combustion engine, comprising:

a rocker arm having a transverse through-hole;

a support pin having a body with a centrally located bore, the body of the support pin having a flat upper surface and a curved lower surface, and the support pin being positioned in the through-hole about which the rocker arm rocks;

a bearing positioned at each end of the support pin in the through-hole between the support pin and the rocker arm; and an anti-inversion part affixed in the bore of the support pin, wherein the anti-inversion feature is a hollow sleeve that extends through the bore of the support pin and rocker arm and is contactable upon movement of the rocker arm with bottom was of the rocker arm, preventing inversion of the support pin.

17. The assembly of claim 16, wherein a bolt is inserted in the sleeve during assembly of the rocker arm.

* * * * *